US008384600B2

(12) United States Patent
Huang et al.

(10) Patent No.: US 8,384,600 B2
(45) Date of Patent: Feb. 26, 2013

(54) HIGH GAIN METAMATERIAL ANTENNA DEVICE

(75) Inventors: Wei Huang, San Diego, CA (US); Gregory Poilasne, El Cajon, CA (US); Vaneet Pathak, San Diego, CA (US)

(73) Assignee: Tyco Electronics Services GmbH (CH)

( * ) Notice: Subject to any disclaimer, the term of this patent is extended or adjusted under 35 U.S.C. 154(b) by 434 days.

(21) Appl. No.: 12/722,481

(22) Filed: Mar. 11, 2010

(65) Prior Publication Data

US 2010/0231464 A1 Sep. 16, 2010

Related U.S. Application Data

(60) Provisional application No. 61/159,320, filed on Mar. 11, 2009.

(51) Int. Cl.
*H01Q 1/38* (2006.01)
*H01Q 9/04* (2006.01)

(52) U.S. Cl. ..... 343/700 MS; 343/702; 343/767; 343/770

(58) Field of Classification Search ..... 343/700 MS, 343/90, 729, 767, 770, 702, 787, 788, 846
See application file for complete search history.

(56) References Cited

U.S. PATENT DOCUMENTS

| | | | | |
|---|---|---|---|---|
| 5,745,080 | A * | 4/1998 | Jun | 343/700 MS |
| 7,248,226 | B2 * | 7/2007 | Yuanzhu | 343/767 |
| 7,812,777 | B2 * | 10/2010 | Yosui et al. | 343/788 |
| 7,847,739 | B2 * | 12/2010 | Achour et al. | 343/700 MS |
| 2007/0176827 | A1 | 8/2007 | Itoh et al. | |
| 2008/0048917 | A1 * | 2/2008 | Achour et al. | 343/700 MS |
| 2008/0258981 | A1 | 10/2008 | Achour et al. | |
| 2008/0258993 | A1 | 10/2008 | Gummalla et al. | |
| 2010/0053006 | A1 * | 3/2010 | Miyoshi et al. | 343/742 |

FOREIGN PATENT DOCUMENTS

| | | | |
|---|---|---|---|
| CN | 102422486 | A | 4/2012 |
| KR | 1020090012363 | | 3/2009 |
| KR | 1020110129462 | A | 12/2011 |
| WO | WO-2010105109 | A2 | 9/2010 |

OTHER PUBLICATIONS

International Application Serial No. PCT/US2010/027057, International Search Report mailed Mar. 11, 2010, 3 pgs.
International Application Serial No. PCT/UWS2010/027057, International Preliminary Report on Patentability mailed Sep. 22, 2011, 6 pgs.
Korean Application Serial No. 1020117023893, Amendment filed Oct. 13, 2011, 4 pgs.
Communication with extended search report and opinion of EPO in EP10751452.3 (counterpart of the above-identified application) dated Nov. 27, 2012.
Wei Huang et al., "Composite Right-Left Handed Metamaterial Ultra-Wideband Antenna", Antenna Technology, 2009. IWAT 2009. IEEE International Workshop on___, Mar. 2, 2009, pp. 1-4.
Nobuhiro Kuga et al., "A Bi-Directional Pattern Antenna Using Short-Tapered Slot Antenna", IEEE Antennas and Propagation Society International Symposium, 2001 Digest, Boston, MA, Jul. 8-13, 2001, vol. 3, Jul. 8, 2001, pp. 460-463.

* cited by examiner

*Primary Examiner* — Vibol Tan

(57) ABSTRACT

An antenna is presented having a flared structure wherein charge is induced from one portion of the structure to another. The flared structure may be a V-shaped or other shaped element. The antenna includes at least one parasitic element to increase the gain of the antenna and extend the radiation pattern generated by the antenna in a given direction.

20 Claims, 22 Drawing Sheets

--PRIOR ART--

--PRIOR ART--

--PRIOR ART--

--PRIOR ART--

--PRIOR ART--

HIGH GAIN METAMATERIAL ANTENNA DEVICE

PRIORITY

This application claims the benefits of the following U.S. Provisional Patent Application Ser. No. 61/159,320 entitled "HIGH GAIN METAMATERIAL ANTENNA DEVICE" and filed on Mar. 11, 2009.

BACKGROUND

This application relates to high gain antenna structures and specifically antenna structures based on metamaterial designs.

Various structures may be used in wireless access points and base stations to implement high gain antennas. Access points may be stationary or mobile units that transmit signals to other receivers, and therefore, act as routers in a wireless communication system. In these applications, high gain antennas are used to extend the signal range and boost the transmit/receive capabilities. As used herein a high gain antenna refers to a directional antenna which radiates a focused, narrow beam, allowing precise targeting of the radio signal in the given direction. The forward gain of a high gain antenna may be evaluated by the isotropic decibel measurement, dBi, which provides an indication of the antenna gain or antenna sensitivity with respect to an isotropic antenna. The forward antenna gain provides an indication of the power generated by the antenna. As the number of wireless devices increases, there is an increasing need for high gain antennas.

DETAILED DESCRIPTION

Figure 2:
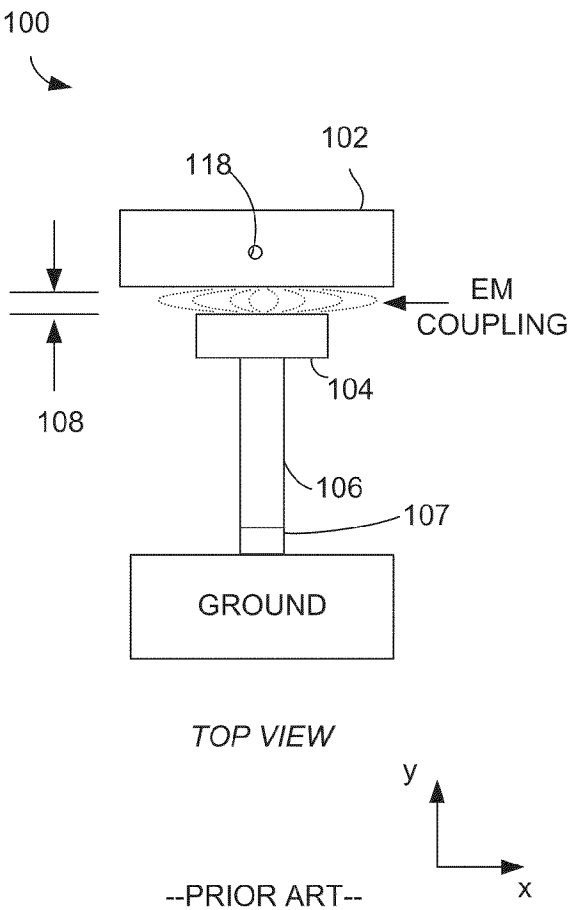
FIGS. 1-2 illustrate an antenna formed on a substrate.

In many applications it is desirable to reduce the Radio Frequency (RF) output power of a device. For example, devices incorporating a high gain antenna generally have increased energy efficiency. Additionally, high gain antennas may be implemented to optimize the cost of manufacturing the device by reducing the elements required to support and operate with the antenna. For example, a high gain antenna reduces the power output level of a Power Amplifier (PA), as seen in the above example, wherein the high gain antenna allows the system to optimize the overall power limit using less power. Further, reducing the power output of the PA may result in reduced Electro-Magnetic Interference (EMI). This may occur as high power outputs tend to include higher harmonic levels and these higher levels increase EMI. High gain antennas act to reduce the power output of the PA and thus reduce EMI.

A metamaterial (MTM) antenna structure may be implemented as a high gain antenna that avoids many of the drawbacks of conventional high gain antennas. A metamaterial may be defined as an artificial structure which behaves differently from a natural RH material alone. Unlike RH materials, a metamaterial may exhibit a negative refractive index, wherein the phase velocity direction is opposite to the direction of the signal energy propagation where the relative directions of the (E, H, β) vector fields follow a left-hand rule. When a metamaterial is designed to have a structural average unit cell size ρ which is much smaller than the wavelength of the electromagnetic energy guided by the metamaterial, the metamaterial behaves like a homogeneous medium to the guided electromagnetic energy. Metamaterials that support only a negative index of refraction with permittivity $\in$ and permeability μ being simultaneously negative are pure Left Handed (LH) metamaterials.

A metamaterial structure may be a combination or mixture of an LH metamaterial and an RH material; these combinations are referred to as Composite Right and Left Hand (CRLH). CRLH structures may be engineered to exhibit electromagnetic properties tailored to specific applications. Additionally, CRLH MTMs may be used in applications where other materials may be impractical, infeasible, or unavailable to satisfy the requirements of the application. In addition, CRLH MTMs may be used to develop new applications and to construct new devices that may not be possible with RH materials and configurations.

A metamaterial CRLH antenna structure provides a high gain antenna that avoids many of the drawbacks of conventional high gain antennas. Such MTM components may be printed onto a substrate, such as a Printed Circuit Board (PCB), providing an easily manufactured, inexpensive solution. The PCB may include a ground plane or a surface having a truncated or patterned ground portion or portions. In such a design, the printed antenna may be designed to be smaller than half a wavelength of the supported frequency range. The impedance matching and radiation patterns of such an antenna are influenced by the size of and the distance to the ground plane. The CRLH antenna structure may have printed components on a first surface of the substrate, and other printed components on the opposite surface or ground plane.

To better understand MTM and CRLH structures, first consider that the propagation of electromagnetic waves in most materials obeys the right-hand rule for the (E, H, β) vector fields, which denotes the electrical field E, the magnetic field H, and the wave vector β (or propagation constant). In these materials, the phase velocity direction is the same as the direction of the signal energy propagation (group velocity) and the refractive index is a positive number. Such materials are referred to as Right/Handed (RH) materials. Most natural materials are RH materials, but artificial materials may also be RH materials.

A CRLH MTM design may be used in a variety of applications, including wireless and telecommunication applications. The use of a CRLH MTM design for elements within a wireless application often reduces the physical size of those elements and improves the performance of these elements. In some embodiments, CRLH MTM structures are used for antenna structures and other RF components) metamaterials. A CRLH metamaterial behaves like an LH metamaterial under certain conditions, such as for operation at low frequencies; the same CRLH metamaterial may behave like an RH material under other conditions, such as operation at high frequencies.

Implementations and properties of various CRLH MTMs are described in, for example, Caloz and Itoh, "Electromagnetic Metamaterials: Transmission Line Theory and Microwave Applications," John Wiley & Sons (2006). CRLH MTMs and their applications in antennas are described by Tatsuo Itoh in "Invited paper: Prospects for Metamaterials," Electronics Letters, Vol. 40, No. 16 (August, 2004).

Metamaterials are manmade composite materials and structures engineered to produce desired electromagnetic propagation behavior not found in natural media. The term "metamaterial" refers to many variations of these man-made structures, including Transmission-Lines (TL) based on electromagnetic CRLH propagation behavior. Such structures may be referred to as "metamaterial-inspired" as these structures are formed to have behaviors consistent with those of a metamaterial.

Metamaterial technology, as used herein, includes technical means, methods, devices, inventions and engineering works which allow compact devices composed of conductive and dielectric parts and are used to receive and transmit electromagnetic waves. Using MTM technology, antennas and RF components may be made very compactly in comparison to competing methods and may be very closely spaced to each other or to other nearby components while at the same time minimizing undesirable interference and electromagnetic coupling. Such antennas and RF components further exhibit useful and unique electromagnetic behavior that results from one or more of a variety of structures to design, integrate, and optimize antennas and RF components inside wireless communications devices CRLH structures are structures that behave as structures exhibiting simultaneous negative permittivity (∈) and negative permeability (μ) in a frequency range and simultaneous positive ∈ and positive μ in another frequency range. Transmission-Line (TL) based CRLH structure are structures that enable TL propagation and behave as structures exhibiting simultaneous negative permittivity (∈) and negative permeability (μ) in a frequency range and simultaneous positive ∈ and positive μ in another frequency range. The CRLH based antennas and TLs may be designed and implemented with and without conventional RF design structures.

Antennas, RF components and other devices made of conventional conductive and dielectric parts may be referred to as "MTM antennas," "MTM components," and so forth, when they are designed to behave as an MTM structure. MTM components may be easily fabricated using conventional conductive and insulating materials and standard manufacturing technologies including but not limited to: printing, etching, and subtracting conductive layers on substrates such as FR4, ceramics, LTCC, MMICC, flexible films, plastic or even paper.

A practical implementation of a pure Left-Handed (LH) TL includes Right-Hand (RH) propagation inherited from the lump elemental electrical parameters. This composition including LH and RH propagation or modes, results in improvements in air interface integration, Over-The-Air (OTA) performance and miniaturization while simultaneously reducing Bill Of Materials (BOM) costs and Specific Absorption Rate (SAR) values. MTMs enable physically small but electrically large air interface components, with minimal coupling among closely spaced devices. MTM antenna structures in some embodiments are built by patterning and printing copper directly on a dielectric substrate, such as in a conventional FR-4 substrate or a Flexible Printed Circuit (FPC) board.

In one example a metamaterial structure may be a periodic structure with N identical unit cells cascading together where each cell is much smaller than one wavelength at the operational frequency. The unit cell is then a single repeatable metamaterial structure. In this sense, the composition of one metamaterial unit cell is described by an equivalent lumped circuit model having a series inductor ($L_R$), a series capacitor ($C_L$), shunt inductor ($L_L$) and shunt capacitor ($C_R$) where $L_L$ and $C_L$ determine the LH mode propagation properties while $L_R$ and $C_R$ determine the RH mode propagation properties. The behaviors of both LH and RH mode propagation at different frequencies can be easily addressed in a simple dispersion diagram such as described herein below with respect to FIGS. 5 and 6 described hereinbelow. In such a dispersion curve, $\beta>0$ identifies the RH mode while $\beta<0$ identifies the LH mode. An MTM device exhibits a negative phase velocity depending on the operating frequency.

An MTM antenna device, for example, includes a cell patch, a feed line, and a via line. The cell patch is the radiating element of the antenna, which transmits and receives electromagnetic signals. The feed line is a structure that provides an input signal to the cell patch for transmission and receives a signal from the cell patch as received by the cell patch. The feed line is positioned to capacitively couple to the cell patch.

The configuration of the feed line capacitively coupled to the cell patch introduces a capacitive coupling to the feed port of the cell patch. The device further includes a via line coupled to the cell patch, and which is part of a truncated ground element. The via line is connected to a separate ground voltage electrode, and acts as an inductive load between the cell patch and the ground voltage electrode.

The electrical size of a conventional transmission line is related to its physical dimension, thus reducing device size usually means increasing the operational frequency. Conversely, the dispersion curve of a metamaterial structure depends mainly on the value of the four CRLH parameters, $C_L$, $L_L$, $C_R$, and $L_R$. As a result, manipulating the dispersion relations of the CRLH parameters enables a small physical RF circuit having electrically large RF signals.

In one example, a rectangular-shaped MTM cell patch having a length L and width W is capacitively coupled to the launch pad, which is an extension of the feed line, by way of a coupling gap. The coupling provides the series capacitor or LH capacitor to generate a left hand mode. A metallic via connects the MTM cell patch on the top layer to a thin via line on the bottom layer and finally leads to the bottom ground plane, which provides parallel inductance or LH inductance.

In some applications, metamaterial (MTM) and Composite Right and Left Handed (CRLH) structures and components are based on a technology which applies the concept of Left-handed (LH) structures. As used herein, the terms "metamaterial," "MTM," "CRLH," and "CRLH MTM" refer to composite LH and RH structures engineered using conventional dielectric and conductive materials to produce unique electromagnetic properties, wherein such a composite unit cell is much smaller than the free space wavelength of the propagating electromagnetic waves.

Many conventional printed antennas are smaller than half a wavelength; thus, the size of the ground plane plays an important role in determining their impedance matching and radiation patterns. Furthermore, these antennas may have strong cross polarization components depending on the shape of the ground plane. A conventional monopole antenna is ground plane-dependent. The length of a monopole conductive trace primarily determines the resonant frequency of the antenna. The gain of the antenna varies depending on parameters such as the distance to a ground plane and the size of the ground plane. In some embodiments, an innovative metamaterial antenna is ground-independent, wherein the design has a small size compared to the operational frequency wavelength, making it a very attractive solution to use in various devices without changing the basic structure of the antenna device. Such an antenna is applicable to Multiple Input-Multiple Output (MIMO) applications since no coupling occurs at the ground-plane level. Balanced antennas, such as dipole antennas have been recognized as one of the most popular solutions for wireless communication systems because of their broadband characteristics and simple structure. They are seen on wireless routers, cellular telephones, automobiles, buildings, ships, aircraft, spacecraft, etc.

In some conventional wireless antenna applications such as wireless access points or routers, antennas exhibit omnidirectional radiation patterns and are able to provide increased coverage for existing IEEE 802.11 networks. The omnidirectional antenna offers 360° of expanded coverage, effectively improving data at farther distances. It also helps improve signal quality and reduce dead spots in the wireless coverage, making it ideal for Wireless Local Area Network (WLAN) applications. Typically however, in small portable devices, such as wireless routers, the relative position between the compact antenna elements and the surrounding ground plane influences the radiation pattern significantly. Antennas without balanced structures, such as, patch antennas or the Planar Inverted F Antenna (PIFA), even though they are compact in terms of size, the surrounding ground planes can easily distort their omni-directionality.

More and more WLAN devices using MIMO technology require multiple antennas, so that the signals from different antennas can be combined to exploit the multipath in the wireless channel and enable higher capacity, better coverage and increased reliability. At the same time, consumer devices continue to shrink in size, which requires the antenna to be designed in a very small dimension. For the conventional dipole antennas or printed dipole antennas, antenna size is strongly dependent on the operational frequency, thus making the size reduction a challenging task.

CRLH structures can be used to construct antennas, transmission lines and other RF components and devices, allowing for a wide range of technology advancements such as functionality enhancements, size reduction and performance improvements. Unlike conventional antennas, the MTM antenna resonances are affected by the presence of the Left-Handed (LH) mode. In general, the LH mode helps excite and better match the low frequency resonances as well as improves the matching of high frequency resonances. These MTM antenna structures can be fabricated by using a conventional FR-4 Printed Circuit Board (PCB) or a Flexible Printed Circuit (FPC) board. Examples of other fabrication techniques include thin film fabrication technique, System On Chip (SOC) technique, Low Temperature Co-fired Ceramic (LTCC) technique, and Monolithic Microwave Integrated Circuit (MMIC) technique.

The basic structural elements of a CRLH MTM antenna is provided in this disclosure as a review and serve to describe fundamental aspects of CRLH antenna structures used in a balanced MTM antenna device. For example, the one or more antennas in the above and other antenna devices described in this document may be in various antenna structures, including right-handed (RH) antenna structures and CRLH structures. In a right-handed (RH) antenna structure, the propagation of electromagnetic waves obeys the right-hand rule for the (E, H, β) vector fields, considering the electrical field E, the magnetic field H, and the wave vector β (or propagation constant). The phase velocity direction is the same as the direction of the signal energy propagation (group velocity) and the refractive index is a positive number. Such materials are referred to as Right Handed (RH) materials. Most natural materials are RH materials. Artificial materials can also be RH materials.

A metamaterial may be an artificial structure or, as detailed hereinabove, an MTM component may be designed to behave as an artificial structure. In other words, the equivalent circuit describing the behavior and electrical composition of the component is consistent with that of an MTM. When designed with a structural average unit cell size ρ much smaller than the wavelength λ, of the electromagnetic energy guided by the metamaterial, the metamaterial can behave like a homogeneous medium to the guided electromagnetic energy. Unlike RH materials, a metamaterial can exhibit a negative refractive index, and the phase velocity direction may be opposite to the direction of the signal energy propagation wherein the relative directions of the (E, H, β) vector fields follow the left-hand rule. Metamaterials having a negative index of refraction and have simultaneous negative permittivity ∈ and permeability μ are referred to as pure Left Handed (LH) metamaterials.

Many metamaterials are mixtures of LH metamaterials and RH materials and thus are CRLH metamaterials. A CRLH metamaterial can behave like an LH metamaterial at low frequencies and an RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials may be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

Metamaterial structures may be used to construct antennas, transmission lines and other RF components and devices, allowing for a wide range of technology advancements such as functionality enhancements, size reduction and performance improvements. An MTM structure has one or more MTM unit cells. As discussed above, the lumped circuit model equivalent circuit for an MTM unit cell includes an RH series inductance $L_R$, an RH shunt capacitance $C_R$, an LH series capacitance $C_L$, and an LH shunt inductance $L_L$. The MTM-based components and devices can be designed based on these CRLH MTM unit cells that can be implemented by using distributed circuit elements, lumped circuit elements or a combination of both. Unlike conventional antennas, the MTM antenna resonances are affected by the presence of the LH mode. In general, the LH mode helps excite and better match the low frequency resonances as well as improves the matching of high frequency resonances. The MTM antenna structures can be configured to support multiple frequency bands including a "low band" and a "high band." The low band includes at least one LH mode resonance and the high band includes at least one RH mode resonance associated with the antenna signal.

One type of MTM antenna structure is a Single-Layer Metallization (SLM) MTM antenna structure, wherein the conductive portions of the Some examples and implementations of MTM antenna structures are described in the U.S. patent application Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. These MTM antenna structures may be fabricated by using a conventional FR-4 Printed Circuit Board (PCB) or a Flexible Printed Circuit (FPC) board.

MTM structure are positioned in a single metallization layer formed on one side of a substrate. In this way, the CRLH components of the antenna are printed onto one surface or layer of the substrate. For a SLM device, the capacitively coupled portion and the inductive load portions are both printed onto a same side of the substrate.

A Two-Layer Metallization Via-Less (TLM-VL) MTM antenna structure is another type of MTM antenna structure having two metallization layers on two parallel surfaces of a substrate. A TLM-VL does not have conductive vias connecting conductive portions of one metallization layer to conductive portions of the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008, the disclosure of which is incorporated herein by reference.

A CRLH MTM design may be used in a variety of applications, including wireless and telecommunication applications. The use of a CRLH MTM design for elements within a wireless application often reduces the physical size of those elements and improves the performance of these elements. In some embodiments, CRLH MTM structures are used for antenna structures and other RF components.

CRLH MTM structures may be used in wireless access points and base stations to implement high gain antennas. Access points may be stationary or mobile units that transmit signals to other receivers, and therefore, act as routers in a wireless communication system. In these applications, high gain antennas are used to extend the signal range and boost the transmit/receive capabilities. As used herein a high gain antenna refers to a directional antenna which radiates a focused, narrow beam, allowing precise targeting of the radio signal in the given direction. The forward gain of a high gain antenna may be evaluated by the isotropic decibel measurement, dBi, which provides an indication of the antenna gain or antenna sensitivity with respect to an isotropic antenna. The forward antenna gain provides an indication of the power generated by the antenna. With the proliferation of wireless devices and applications, many governments regulate the generated power, such as to set a limit to the allowed Effective Isotropic Radiated Power (EIRP), in dBm. This is the radiated power measured relative to 1 milliwatt (mW).

For example, consider a device incorporating an antenna having a peak gain of 3 dBi. Where a regulation limits the maximum EIRP of such a wireless device to 30 dBm, there remains a power level difference of approximately 27 dBm. This means that the antenna could radiate 27 dBm and remain within the allowable limits. The 3 dBi antenna is then able to optimize the output power range for this application using the 27 dBm. Compare this to a higher gain antenna, wherein the peak gain of the antenna was 6 dBi. Using this high gain antenna, the same wireless device could be designed to optimize the power range, using a lower power level of 24 dBm. Thus, for wireless applications, the gain of the antenna has a direct relation on the power consumption of the device. In this way, a higher gain antenna is able to optimize a given output power range using less power than a lower gain antennas. In a system employing a smart antenna algorithm to direct the antenna radiation, the EMI with the surrounding devices can also be reduced because the high gain antennas radiate only in the direction of a client device.

In many applications it is desirable to reduce the Radio Frequency (RF) output power of a device. For example, devices incorporating a high gain antenna generally have increased energy efficiency. Additionally, high gain antennas may be implemented to optimize the cost of manufacturing the device by reducing the elements required to support and operate with the antenna. For example, a high gain antenna reduces the power output level of a Power Amplifier (PA), as seen in the above example, wherein the high gain antenna allows the system to optimize the overall power limit using less power. Further, reducing the power output of the PA may result in reduced EMI. This may occur as high power outputs tend to include higher harmonic levels and these higher levels increase EMI. High gain antennas act to reduce the power output of the PA and thus reduce EMI.

Examples of conventional high gain antennas include horn antennas and patch antennas. The radiation pattern of a dipole antenna has a toroidal shape (doughnut shape) with the axis of the toroid centering around the dipole, and thus it is omnidirectional in the azimuthal plane when the dipole size is about half a wavelength. A dipole can be made directional by making the size different from half a wavelength. For example, a full-wave dipole has the antenna gain of 3.82 dBi. More directivity can be obtained with a length of about 1.25λ. However, when the dipole is made longer, the radiation pattern begins to break up and the directivity drops sharply. Furthermore, full-wave dipoles, and even half-wave dipoles, are large in size and therefore do not always fit in a modern wireless device. Horn antennas have high gains, but they are also too bulky to fit in a modern wireless device. Another drawback with a horn antenna is that multiple horn antennas are often needed to provide a required coverage because the directivity can be too high for some applications. Patch antennas can be compact in size if loaded with high dielectric materials and can deliver high gain. However, they tend to be too expensive to implement in wireless devices.

A CRLH MTM antenna structure provides a high gain antenna that avoids many of the drawbacks of conventional high gain antennas. CRLH MTM components may be printed onto a substrate, such as a PCB, providing an easily manufactured, inexpensive solution. The PCB may include a ground plane or a surface having a truncated or patterned ground portion or portions. In such a design, the printed antenna may be designed to be smaller than half a wavelength of the supported frequency range. The impedance matching and radiation patterns of such an antenna are influenced by the size of and the distance to the ground plane. The CRLH MTM antenna structure may have printed components on a first surface of the substrate, and other printed components on the opposite surface or ground plane.

Figure 26:
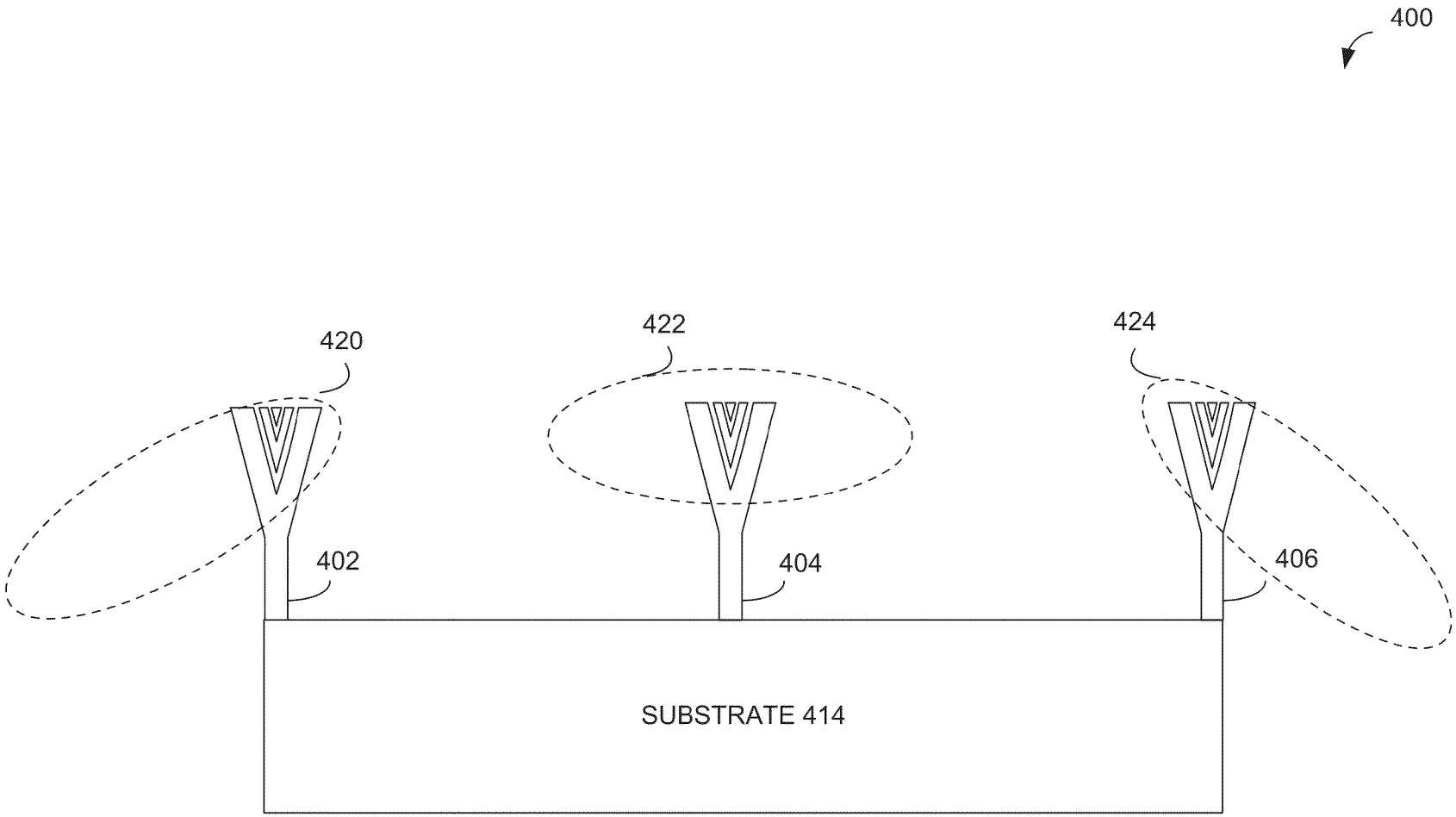
FIG. 26 illustrates a configuration of multiple antennas, according to an example embodiment.

Using CRLH MTM structure(s), high gain may be achieved using small printed antenna(s) strategically placed with respect to a large ground plane. The closer the antenna is placed to the ground plane, the stronger the coupling there will be between the antenna and the ground plane. In other words, the distance between the antenna and the ground plane is inversely proportional to the strength of the electromagnetic coupling therebetween. Additionally, when the antenna is placed close to a corner or edge of the ground plane, such as at the edge of a device the resultant radiation pattern will be directed toward that corner or edge, such as illustrated in the configuration of FIG. 26, wherein the radiation pattern of antenna 402 has a radiation pattern directed to the left of the substrate 414, and the antenna 406 has a radiation pattern 424 directed to the right of the substrate 414.

The antenna gain, however, varies significantly with the antenna position relative to the ground plane. CRLH MTM structures may be used to construct antennas, transmission lines, RF components and other devices, allowing for a wide range of technology advancements including functionality enhancement, size reduction and performance improvement. A high gain CRLH MTM antenna structure may provide these advancements while delivering high directivity and reducing the size of the antenna structure.

Unlike conventional antennas, the MTM antenna resonances are affected by the presence of the LH mode. In general, the LH mode helps excite and better match the low frequency resonances as well as improves the matching of high frequency resonances. These MTM antenna structures may be incorporated on a conventional FR-4 Printed Circuit Board (PCB) or a Flexible Printed Circuit (FPC) board. Examples of other fabrication techniques and applications include thin film fabrication technique, System On Chip (SOC) technique, Low Temperature Co-fired Ceramic (LTCC) technique, and Monolithic Microwave Integrated Circuit (MMIC) technique.

In one embodiment, a high gain CRLH MTM antenna incorporates a parasitic capacitive element to enhance the directional radiation of the antenna. The parasitic capacitive element is positioned proximate a radiating portion of the antenna, wherein an electromagnetic coupling exists between the radiating portion of the antenna and the parasitic capacitive element. This coupling effects the directionality of the antenna. A variety of configurations may be implemented to apply a parasitic capacitive element to a CRLH MTM antenna or antenna array.

Figure 1:
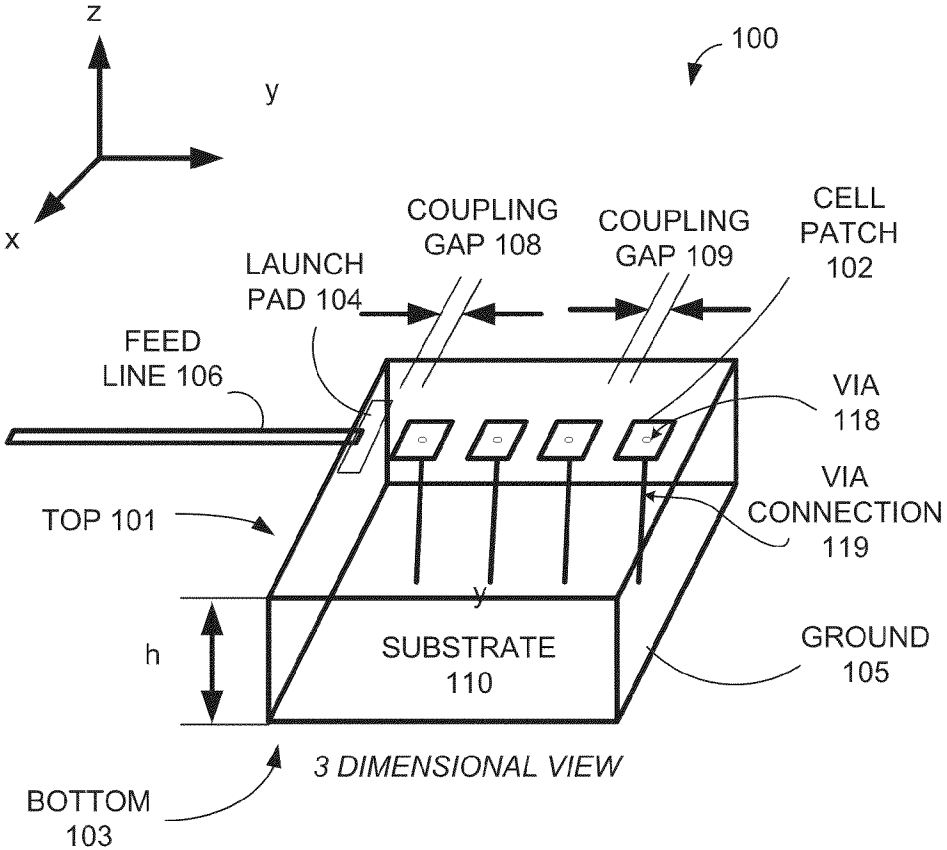

FIG. 1 illustrates a prior art MTM antenna structure 100 configured on a substrate 110. Some or all of the portions of the antenna structure 100 may include conductive material printed onto the substrate 110, such as on multiple sides of a substrate 110. The substrate 110 includes a dielectric material that electrically isolates a first surface of the substrate 110 from another surface. A surface of the substrate 110 may be a layer included in a multilayer structure, such as at least a portion of a PCB or application board in a wireless-capable device. The antenna structure 100 incorporates a CRLH metamaterial structure or configuration which, as described above, is a structure that acts as an LH metamaterial under some conditions and acts as an RH material under other conditions. In one example, a CRLH MTM structure behaves like an LH metamaterial at low frequencies and an RH material at high frequencies, thus allowing multiple frequency ranges and/or expanding or broadening an operational frequency range of a device. CRLH MTMs are structured and engineered to exhibit electromagnetic properties tailored for the specific application and used to develop new applications and to construct new devices. An MTM antenna structure may be built using a variety of materials, wherein the structure behaves as a CRLH material.

The antenna structure 100 includes a plurality of unit cells, wherein each unit cell acts as a CRLH MTM structure. A unit cell includes a cell patch 102 and a via 118, wherein the via 118 enables coupling of the cell patch 102 to a ground electrode 105 through a via connection 119. The via connection 119 is a conductive trace or element connecting two vias on different surfaces or layers of the substrate 110. A launch pad 104 is configured proximate one of the cell patches 102, such that signals received on a feed line 106 are provided to the launch pad 104. The cell patch 102 is capacitively coupled to the launch pad 104 through coupling gap 108. The signal transmissions cause charge to accumulate on the launch pad 104. From the launch pad 104 electrical charge is induced on the cell patch 102 due to the electromagnetic coupling of between the launch pad 104 and the cell patch 102. Similarly, for signals received at the antenna, charge accumulates on the cell patch 102, and the charge is then induced onto the launch pad 104 due to the electromagnetic coupling.

The substrate 110 may include multiple layers, such as two conductive layers separated by a dielectric layer. In such a configuration, elements of the antenna structure 100 may be printed or formed on a first layer using a conductive material, while other elements are printed or formed on a second layer. One of the first and second layers may include a ground electrode. The antenna structure 100 illustrated in FIG. 1 has a ground electrode 105 to which the via connections 119 are coupled. Each via connections 119 provides an inductive load to the corresponding cell patch 102. The capacitive coupling at the feed to a cell patch 102 and the inductive loading to ground facilitate the LH and RH behavior of the antenna structure 100.

The cell patches 102 are the radiators of the antenna 100, which are configured along a first layer or surface of a substrate 110. For clarity the surface on which the cell patches 102 are formed is referred to as the top surface or layer 101. The second surface or layer is then referred to as the bottom surface or layer 103. In the orientation illustrated, the substrate 110 has a height dimension in the z-direction.

Within the top surface 101, a coupling gap 108 spaces a terminal cell patch 102 and a corresponding launch pad 104. Further, each cell patch 102 is separated from a next cell patch 102 by a coupling gap 109. The launch pad 104 is coupled to a feed line 106 for providing signals to and receiving signals from the cell patch 102. Each cell patch 102 has a via 118 and is coupled to the ground 105 by a via connection 119. The bottom surface of the substrate 110 may be a ground plane or may include a truncated ground portion, such as a ground electrode patterned onto the bottom structure 103.

FIG. 2 is an additional view of a portion of antenna structure 100, illustrating the cell coupling which exists between the cell patch 102 and the launch pad 104 of antenna 100. As illustrated, the cell coupling occurs within the coupling gap 108. The launch pad 104 is coupled to the feed line 106, and receives electrical signals for transmission from the antenna 100. The electrical voltage present on the launch pad 104 has an impact on the cell patch 102 due to the cell coupling. In other words, an electrical voltage is induced on the cell patch 102 in response to the electrical condition of the launch pad 104. The amount of cell coupling is a function of the geometries of the launch pad 104, the cell patch 102 and the coupling gap 108. As illustrated, the cell patch 102 has a via 118 which couples to the via connection 119 and to the ground electrode 105. The feed line 106 is coupled to a feed port 107, which is electrically connected to ground 111. The ground 111 may be part of the top surface 101 or may be part of another layer.

Antenna measurement techniques measure various parameters of an antenna, including but not limited to gain, radiation pattern, beamwidth, polarization, and impedance. The antenna pattern or radiation pattern is the response of the antenna to a signal provided to the antenna, such as through a feed port, and which is then transmitted by the antenna.

The measurements of the radiation pattern are typically plotted in a 3-dimensional or 2-dimensional plot. Most antennas are reciprocal devices and behave the same on transmit and receive. The radiation pattern is a graphical representation of the radiation, such as far-field, properties of an antenna. The radiation pattern shows the relative field strength of transmissions. As antennas radiate in space, there are a variety of ways to illustrate or graph the radiation patterns and thus describe the antenna. When the antenna radiation pattern is not symmetric about an axis, multiple views may be used to illustrate the antenna response and behavior. The radiation pattern of an antenna may also be defined as the locus of all points where the emitted power per unit surface is the same. The radiated power per unit surface is proportional to the squared electrical field of the electromagnetic wave. The radiation pattern is the locus of points with the same electrical field. In such a representation, the reference is usually the best angle of emission. It is also possible to depict the directive gain of the antenna as a function of the direction. Often the gain is given in dB.

Radiation graphs may use cartesian coordinates or a polar plot, which is useful to measure the beamwidth, which is, by convention, the angle at the −3 dB points around the maximum gain. The shape of curves can be very different in cartesian or polar coordinates and with the choice of the limits of the logarithmic scale.

Radiation from a transmitting antenna vary inversely with distance. The variation with observation angles depends on the antenna. Observation angles include The radiation pattern gives the angular variation of radiation from an antenna when the antenna is transmitting. The radiation pattern may be used to determine the directionality of an antenna. For example, an omnidirectional antenna with constant radiation may be desirable for one type of broadcast situation. Another situation may a more directed beam. The directivity indicates how much greater the peak radiated power density is for that antenna than it would be if all the radiated power were distributed uniformly around the antenna. The directivity of an antenna may be considered the ratio of the power density in the direction of the pattern maximum to the average power density at the same distance from the antenna. The gain of an antenna is then the directivity reduced by losses of the antenna. Bandwidth is the range of frequencies over which important performance parameters are acceptable.

Gain is an antenna parameter measuring the directionality of a given antenna. An antenna with a low gain emits radiation in all directions equally, whereas a high-gain antenna will preferentially radiate in particular directions. Specifically, the gain, directive gain or power gain of an antenna is defined as the ratio of the intensity (power per unit surface) radiated by the antenna in a given direction at an arbitrary distance divided by the intensity radiated at the same distance by an hypothetical isotropic antenna.

The transmissions from an antenna are electromagnetic waves which vary over time and may be observed with respect to frequency, magnitude, phase, and polarization. The gain of an antenna may be described with respect to the polarization, and as the polarization varies over time and has a spatial coordinate, the gain may be measured for a given point in time, by the strength of the electric field. In this way, the measurement has two components, magnitude and direction of the electric field. Typically, this is plotted as two measures: a first corresponding to the magnitude of the electric field in the direction of polarization, and second corresponding to the magnitude of the electric field at a 90° angle to the direction of polarization. This is a 2-dimensional plot. The first measure is referred to as the co-polarization gain or ⊖ gain; and the second is referred to as the cross-polarization gain or Ø gain. Finally, the total gain may be considered the total of the co-polarization gain and the cross-polarization gain. In some of the following illustrations, the radiation pattern is described using such techniques.

Figure 3:
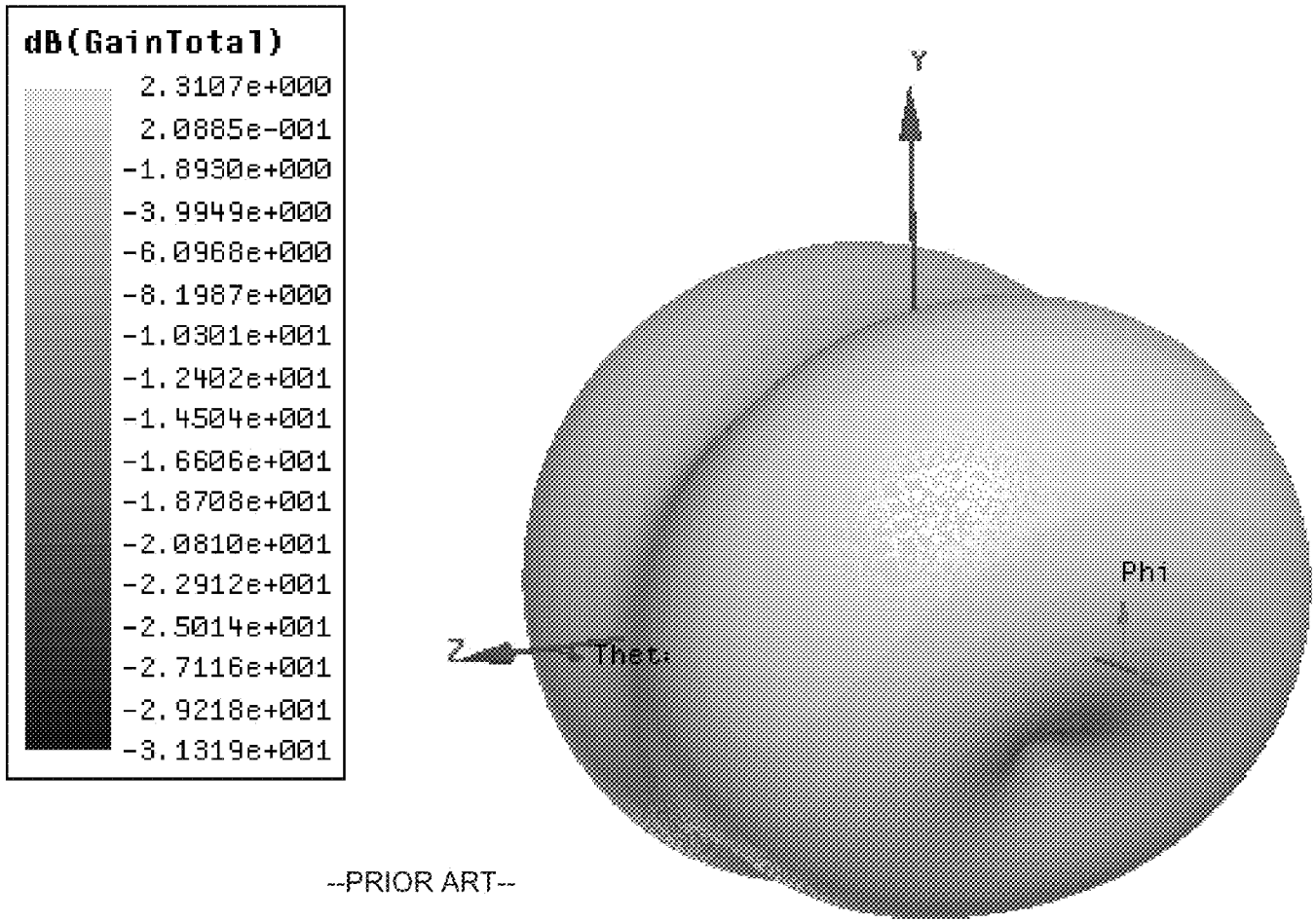
FIGS. 3-4 are plots illustrating radiation patterns associated with the antenna of FIGS. 1-2.
Figure 4:
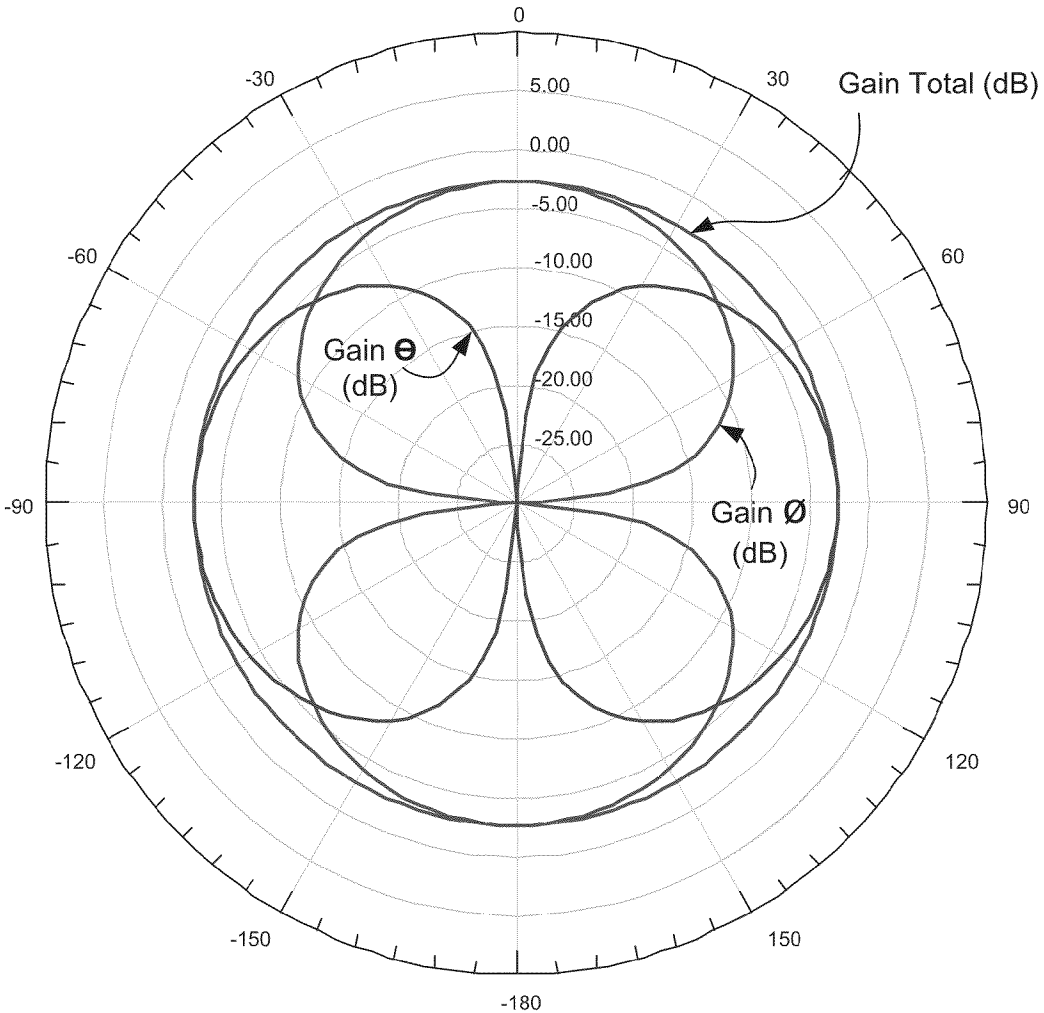

FIG. 3 illustrates the radiation pattern generated by the antenna 100 of FIG. 1. The radiation pattern is illustrated in 3-dimensions, and presents as a donut shape mirrored about the y-axis. FIG. 4 plots the ⊖ gain, the Ø gain and the total gain in dB, which corresponds to the cross-polarization, co-polarization and the combination of these two, respectively. They are the x-z cut of the 3-dimensional radiation pattern of FIG. 3. For a compact antenna, such as illustrated in FIGS. 1 and 2, the cross-polarization is similar to the co-polarization. As illustrated by FIGS. 3 and 4, the radiation pattern is not significantly directional, but rather is more approximately omnidirectional about the x-axis.

Figure 5:
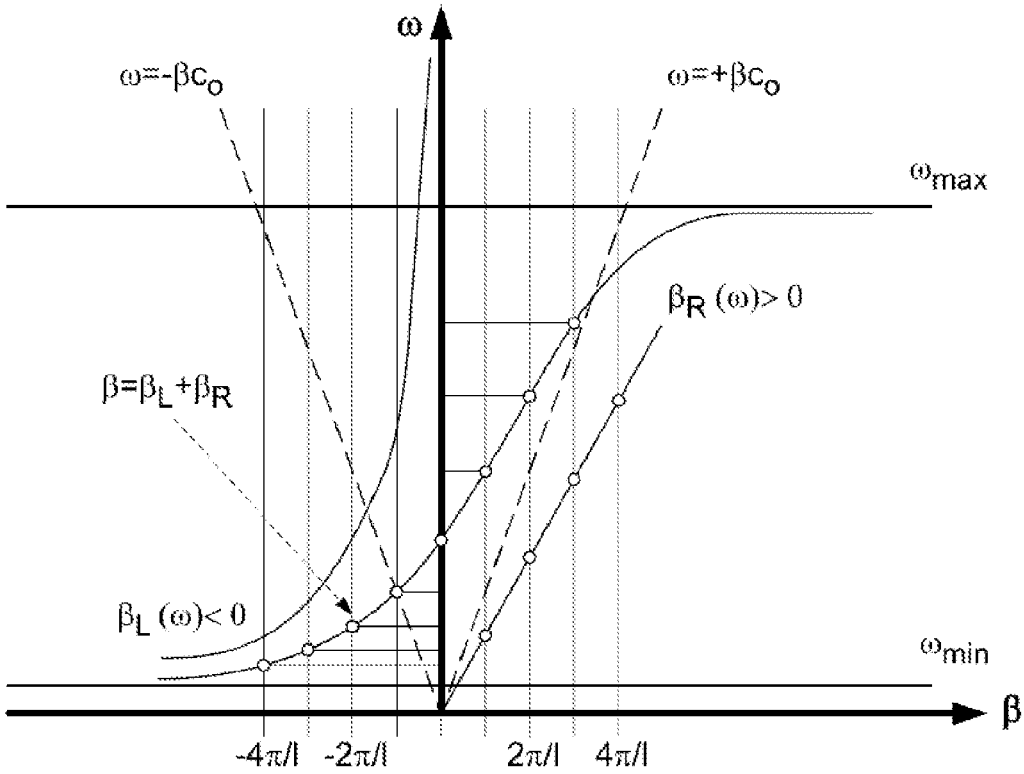
FIGS. 5 and 6 are plots of dispersion curves associated with metamaterial structures.
Figure 6:
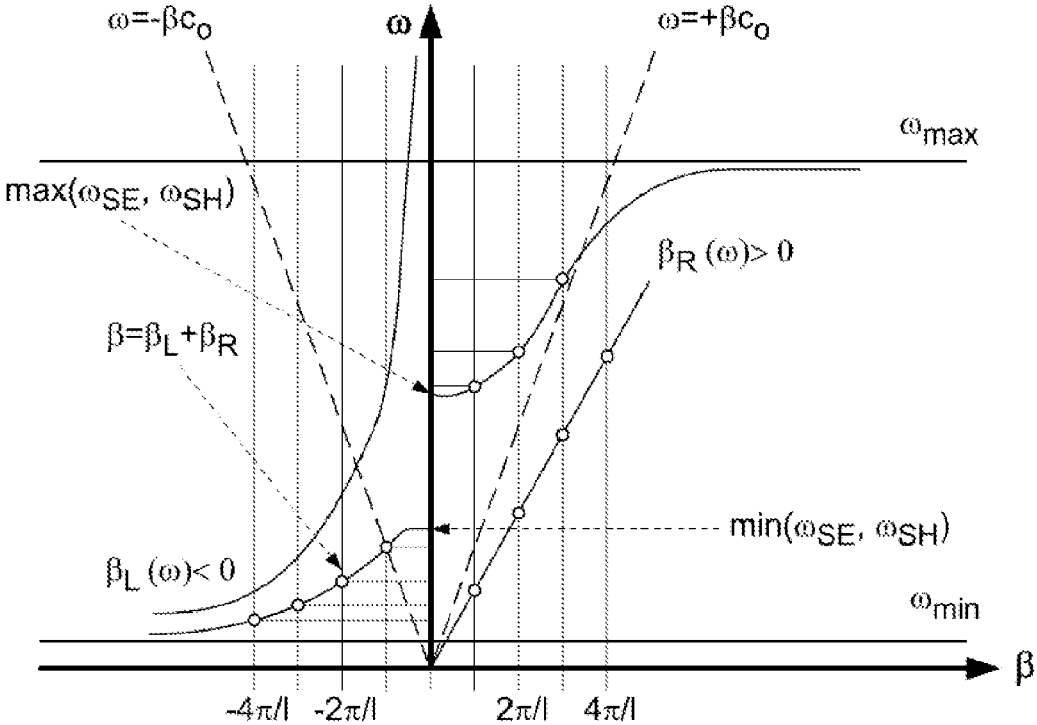

FIGS. 5 and 6 are dispersion curves associated with the metamaterial structure 100 of FIG. 1 considering balanced and unbalanced cases. The CRLH dispersion curve for a unit cell plots the propagation constant β as a function of frequency ω, as illustrated in FIGS. 5 and 6, considers the $\omega_{SE}=\omega_{SH}$ (balanced, i.e., $L_R C_L=L_L C_R$) and $\omega_{SE}\neq\omega_{SH}$ (unbalanced) cases, respectively. In the latter case, there is a frequency gap between $\min(\omega_{SE},\omega_{SH})$ and $\max(\omega_{SE},\omega_{SH})$. In addition, FIGS. 5 and 6 provide examples of the resonance position along the dispersion curves. In the RH region (n>0, where n is the refractive index of the unit cell) the structure size l, given by l=Np, where p is the unit cell size, increases with decreasing frequency. In contrast to the RH region, in the LH region, lower frequencies are reached with smaller values of Np, and therefore LH region allows size reduction of the unit cell.

Figure 7:
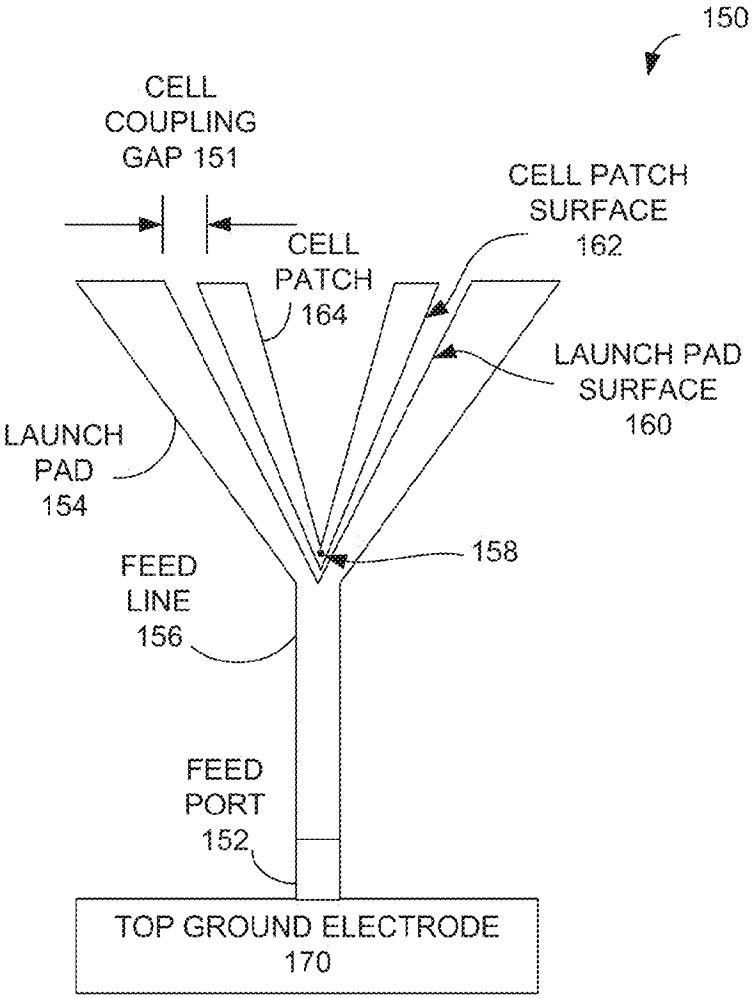

By changing the shape of the antenna components, a directional antenna may be built using one or more MTM unit cells, similar to those illustrated in FIGS. 1 and 2. Note that antenna structure 100 is configured such that the shape of the cell patch 102 and the launch pad 104 are regular geometric shapes, wherein one side of the launch pad 104 matches one side of the cell patch 102. In one example illustrated in FIGS. 7 and 8, the shape of the antenna structure 150 is a V-shape. The antenna structure 150 includes a cell patch 154 having two components which form a V-shape, and includes a launch pad 154 having two components forming a V-shape that is substantially complementary to the cell patch 164. Operationally, capacitive coupling occurs between the spacing or gap between the cell patch surface 160 and the launch pad surface 150. In other words, the configuration of and the spacing between the launch pad 154 and cell patch 164 enables capacitive coupling. The spacing is a cell coupling gap 151 identifies the area between the cell patch 164 and the launch pad 154. The combination of cell patch 164 and launch pad 154 seeks to optimize the area of capacitive coupling therebetween. The cell patch 164 includes a via 158, which is formed in the substrate and provides an inductive load to the antenna structure 150. The antenna structure 150 further has a feed line 156 coupled to the launch pad 154; the feed line 156 is coupled to a feed port 152 coupled to a ground electrode 170. The antenna 150 further includes bottom layer, wherein a via line is coupled to a ground electrode, similar to the configuration of FIG. 12.

Figure 8:
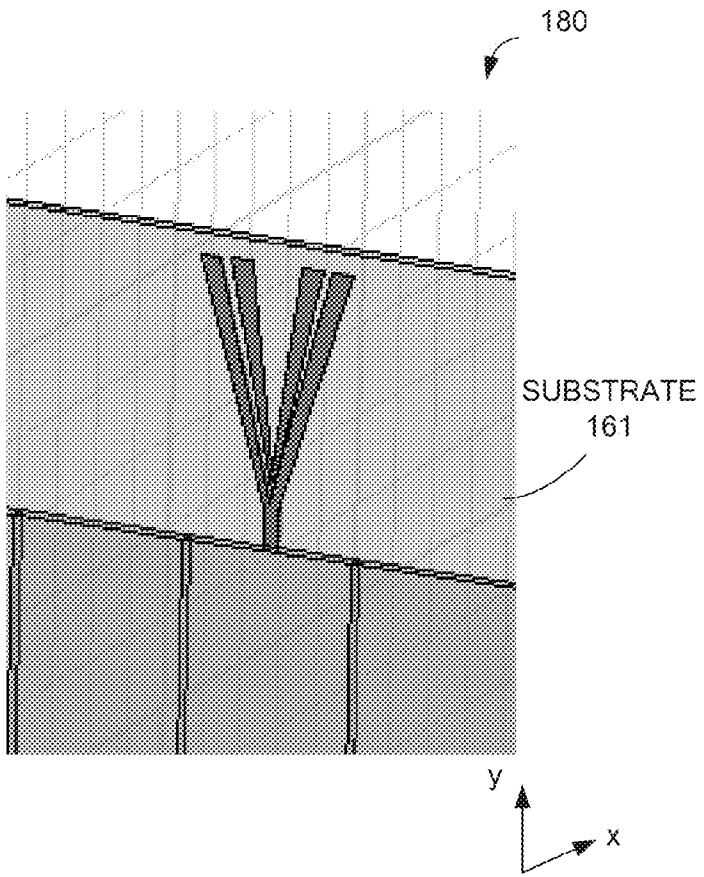
FIGS. 7 and 8 illustrate a Y-shaped metamaterial antenna structure, according to an example embodiment.

FIG. 8 illustrates a configuration 180 which shows the positioning of the antenna structure 150 within a substrate 161. The antenna structure 150 may be printed onto a dielectric, such as a PCB or FR-4. Similarly, the antenna structure 150 may be configured on one or multiple boards, such as on a daughter board type configuration.

Figure 9:
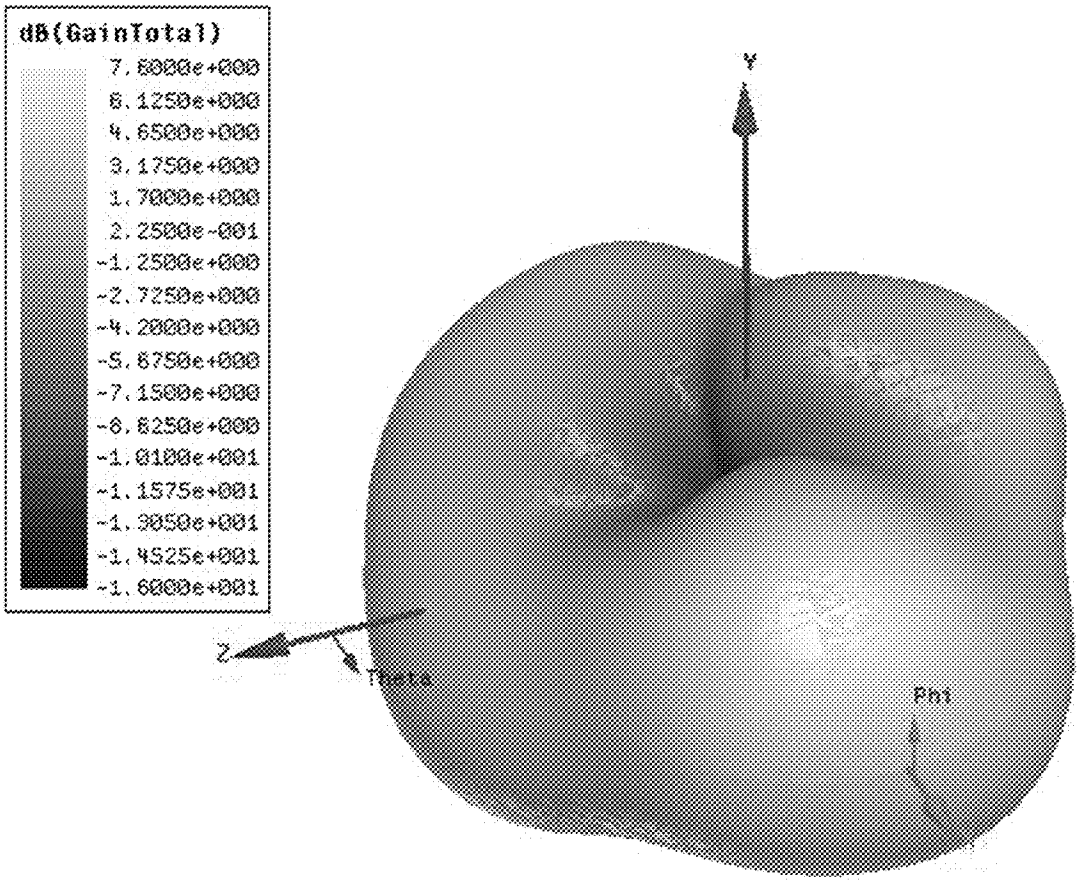
FIGS. 9 and 10 are plots illustrating radiation patterns associated with the antenna structure of FIGS. 7 and 8, according to an example embodiment.
Figure 10:
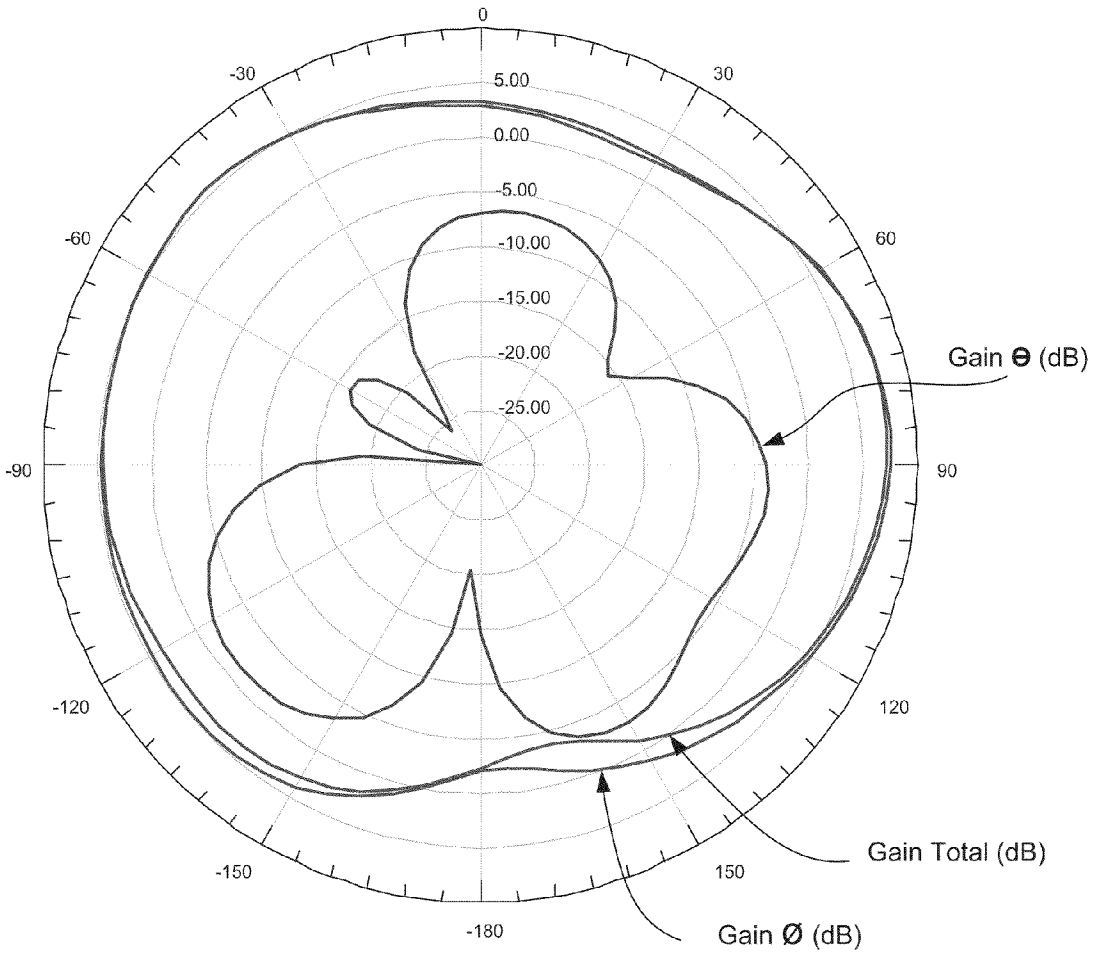

FIG. 9 illustrates the radiation pattern associated with antenna structure 150. The shape of the radiation pattern of the antenna structure 150 is different from that of antenna structure 100, having components in the y-z plane. The differences are more pronounced in FIG. 10, which shows a two dimensional view of the radiation pattern in the x-z plane.

Figure 11:
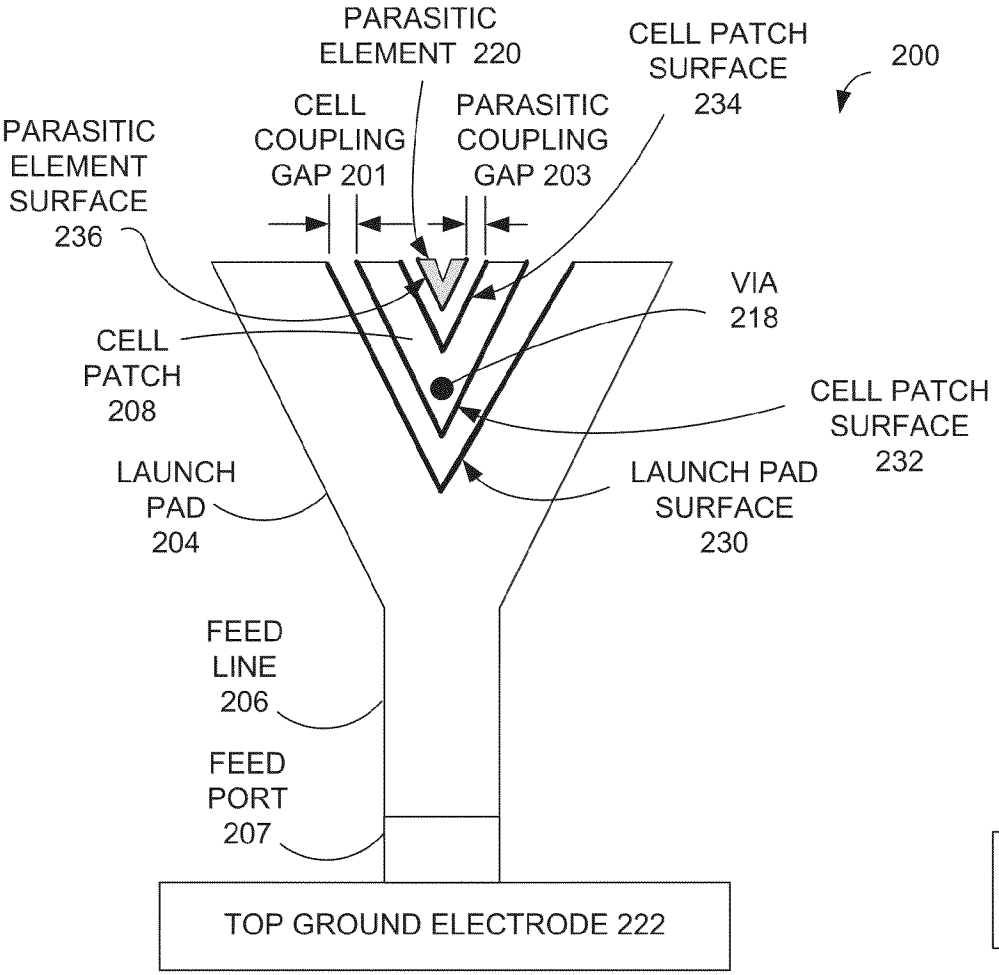
FIG. 11 illustrates a first portion of a Y-shaped metamaterial antenna structure having a capacitive element positioned proximate the cell patch of the antenna structure and capacitively coupled thereto, according to an example embodiment.

The addition of a capacitive element to a structure such as antenna structure 150 acts to improve the directionality of the antenna. FIG. 11 illustrates an antenna 200 having a V-shaped cell patch with a substantially complementarily shaped capacitive element. The antenna 200 of FIG. 11 has a launch pad 204 having multiple components, portions or elongated elements. In the illustrated embodiment, the launch pad 204 is V-shaped. The cell patch 208 has a substantially complementary shape that shares multiple edges or surfaces. The launch pad 204 has a launch pad surface 230 which is in a V-shape. The cell patch 208 has a similar but smaller V-shape and surface cell patch surface 232 which corresponds thereto. When a charge or current is driven onto the launch pad 204 through the feed line 206 a charge is induced on the cell patch 208 by way of electromagnetic coupling between the launch pad 204 and the cell patch 208 in cell coupling gap 201. A feed port 207 is coupled to the feed line 206 to enable coupling to a signal source. In one example the feed port 207 couples to a coaxial cable. Still further, other antenna embodiments may implement alternate shapes or variations of the shapes.

The antenna 200 further includes a parasitic element 220 which has a shape similar to that of the cell patch 208 and the launch pad 204. The parasitic element 220 is in a V-shape and has a parasitic element surface 236. As charge is induced on the cell patch 208 it is further induced on the parasitic element 220 through coupling in the parasitic coupling gap 203. By providing the reduced surface area of multiple radiators, such as cell patch 208 and parasitic element 220, the resultant beam formed by the antenna 200 is then more strongly directed in a specific direction. Other embodiments may implement alternate shapes or variations of the shapes illustrated in FIGS. 11 and 7.

Figure 12:
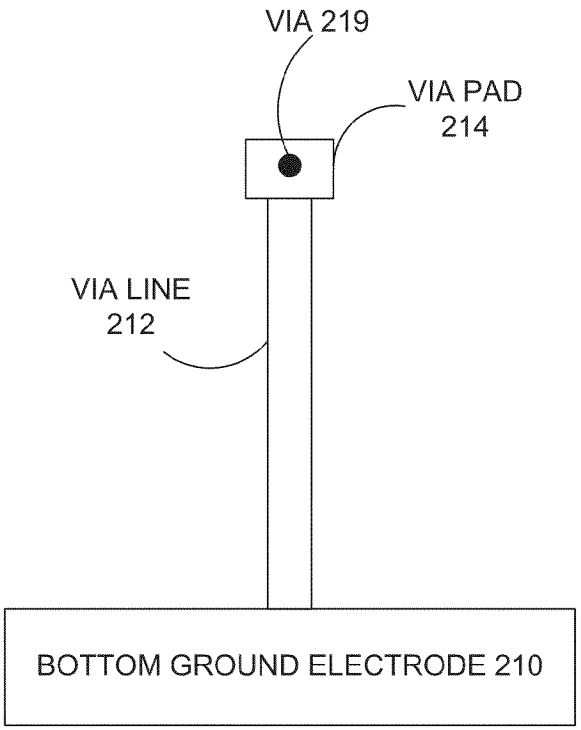
FIG. 12 illustrates a second portion of the antenna structure of FIG. 11 providing inductive loading to the first portion of the antenna structure, according to an example embodiment.

The features of antenna 200 illustrated in FIG. 11 are formed on a first surface or top surface of a substrate or PCB. Corresponding features are illustrated in FIG. 12, which are formed on a separate layer or bottom surface of the substrate. A bottom ground electrode 210 is coupled to a via line 212. The via line 212 couples a via pad 214 to a bottom ground electrode 210, wherein a via connection point 219 is positioned on the via pad 214 to provide an electrical connection between a via connection point 218 on the cell patch 208 of the first surface of the substrate. In other words, the via connection points 218 and 219 form a via that penetrates through the substrate to provide a conductive path between cell patch 208 and via line 212. The features of FIGS. 11 and 12 may be made of a conductive material formed or printed on the respective surfaces of the substrate, which may be a metal such as copper or other conductive material.

Figure 13:
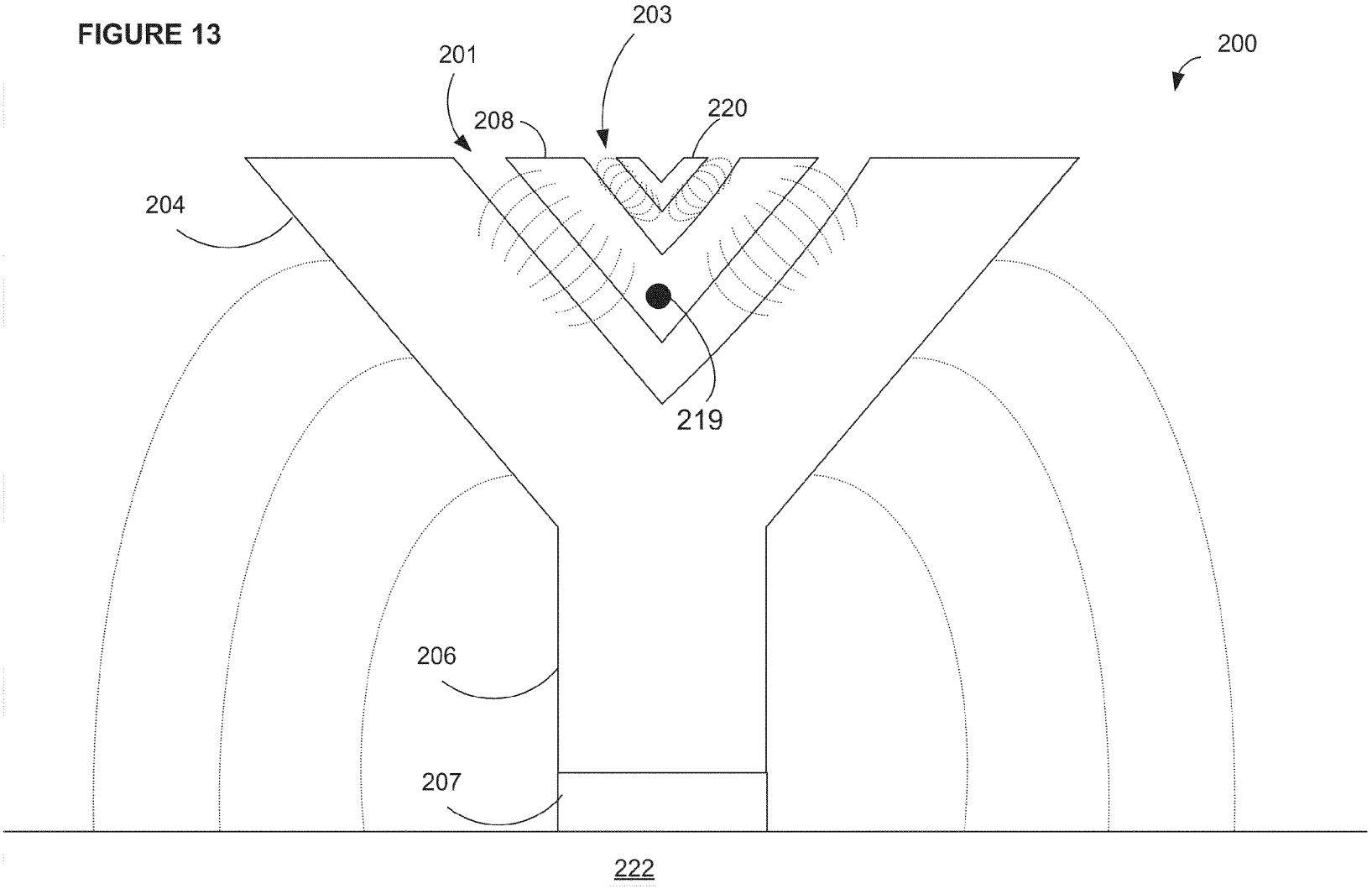
FIG. 13 illustrates electromagnetic coupling of the first portion of the antenna of FIG. 11 in situ on the first layer of the substrate material, according to an example embodiment.

FIG. 13 illustrates the electromagnetic coupling between elements of the antenna 200 in FIG. 11. The coupling between the launch pad 204 and the cell patch 208 is identified within cell coupling gap 201. The electromagnetic coupling acts to induce charge onto the cell patch 208 when charge is driven onto the launch pad 204. Similarly, when charge is received at the antenna 200, and specifically onto the cell patch 208, the electromagnetic coupling acts to induce charge on the launch pad 204. As illustrated, electromagnetic coupling exists along a first axis which is between a first element of the launch pad 204 and a first side of the cell patch 208, wherein the first axis is approximately parallel to the first element of the launch pad. Electromagnetic coupling also exists along a second axis, different from the first axis, between a second element of the launch pad 204 and a second side of the cell patch 208. Further, electromagnetic coupling also exists between a third side of the cell patch 208 and a first side of the parasitic conductive element 220; electromagnetic coupling exists between a fourth side of the cell patch 208 and a second side of the parasitic conductive element 220.

Figure 14:
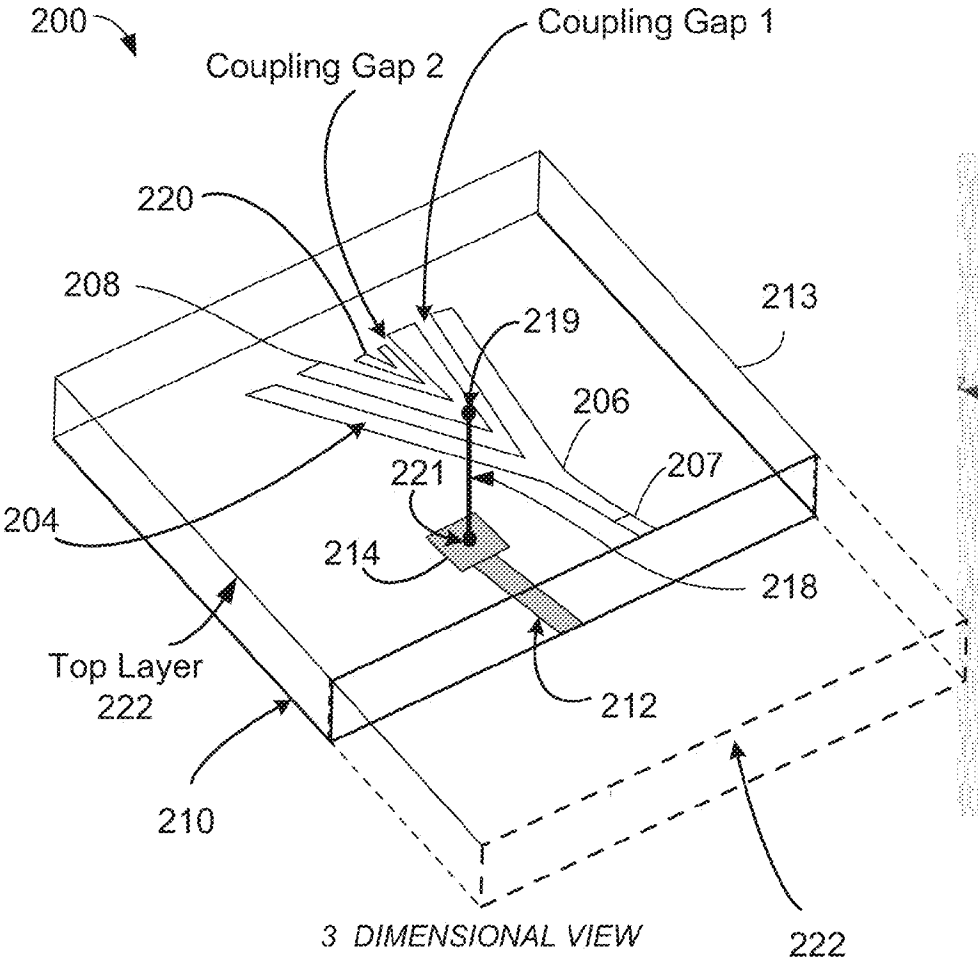

FIG. 14 illustrates the antenna 200 as formed on a substrate 213 having a bottom ground electrode 210 and a top layer 222. The feed line 206 and the launch pad 204 are formed and configured on the top layer 222. The cell patch 208 and the parasitic capacitive element 220 are also formed and configured on the top layer 222. As illustrated, the launch pad 204, the parasitic capacitive element and the cell patch 208 each has a V-shape; these elements are configured to substantially complement each other in a stack. The configuration of these elements provides an effective radiation path due to the capacitive coupling between these elements.

Continuing with FIG. 14, the cell patch 208 includes a via connection point 219 which couples to a via 218. The via 218 then couples to a via connection point 221 within the via pad 214 on the bottom surface. The via pad 214 is coupled to the via line 212 which is coupled to a bottom ground electrode, which is not shown in FIG. 14, but illustrated in FIG. 12. The substrate 213 may include a dielectric layer separating the top layer 222 and the bottom surface or ground electrode 210. The bottom ground electrode 222 is configured to meet the via line 21, as illustrated in FIG. 13. The bottom ground electrode 22 is illustrated in FIG. 14, for clarity of understanding, as on the bottom layer or surface of the dashed line box positioned for electrical contact with via line 212.

According to example embodiments, a structure of a high gain MTM antenna formed on a substrate 213 having a top layer 222 and a bottom layer 210, may be a pattern printed or formed on various metal parts of the substrate 213. The resultant high gain MTM antenna 200 has a portion on a top layer made up of a cell patch 208 and a launch pad 204 separated from the cell patch 208 by a coupling gap 1. This portion is then coupled to a via pad 214 and a via line 212 which are formed on an opposite layer, the bottom layer 210, which may also include a bottom ground portion. Note, the substrate 213 may include any number of layers, wherein the various portions of the antenna 200 are positioned at different layers within the substrate 213. For example, the top layer 222 and bottom layer 210 may not be on the outside of the substrate 213, but may be layers within the substrate 213, wherein a dielectric or other isolating material is positioned between the top layer 222 and the bottom layer 210. The top layer 222 may include a ground portion that is formed above and separated from the bottom ground of the bottom layer 210 such that for example a co-planer waveguide (CPW) feed port 207 may also be formed in the top layer 222 or ground portion. The CPW feed port 207 is then connected to the feed line 206 to deliver power. A parasitic element 220 is then formed in the top layer 222, separated from the cell patch 208 by a coupling gap 2, wherein the coupling gap 2 may have different dimensions from the coupling gap 1 between the cell patch 208 and the launch pad 204. The launch pad 204, cell patch 208 and parasitic element 220 form a nested V-shape, wherein the structure is symmetric with respect to the feed line 206 and via line 212 in this example. There are a variety of feeding mechanisms for an antenna (e.g. CPW, microstrip line, coaxial cable. CPW is provided in one example.

Figure 15:
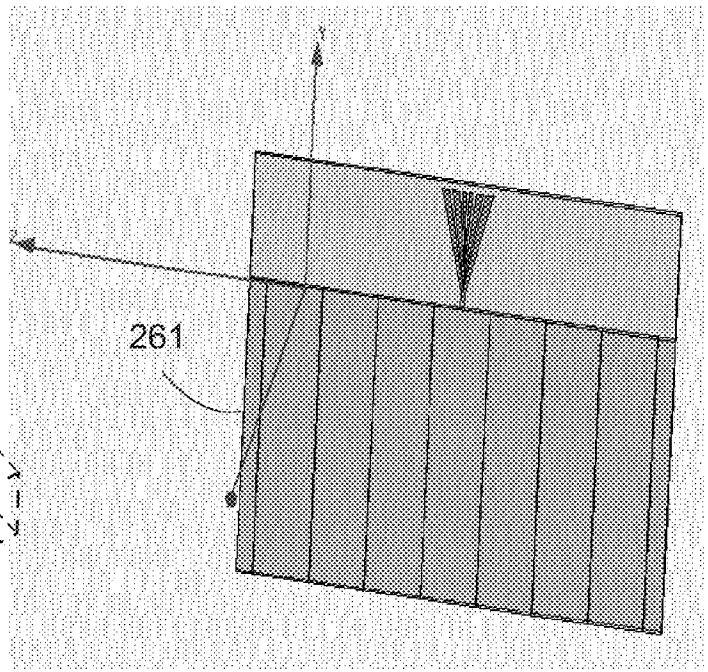
FIGS. 14 and 15 illustrate a 3-dimensional view of an antenna structure as in FIGS. 11 and 12, formed on a substrate, according to an example embodiment.

FIG. 15 identifies configuration 240 positioning of the antenna 200 within the substrate 261. The antenna 200 may be formed on a dielectric substrate, such as printed on one or multiple layers.

Figure 16:
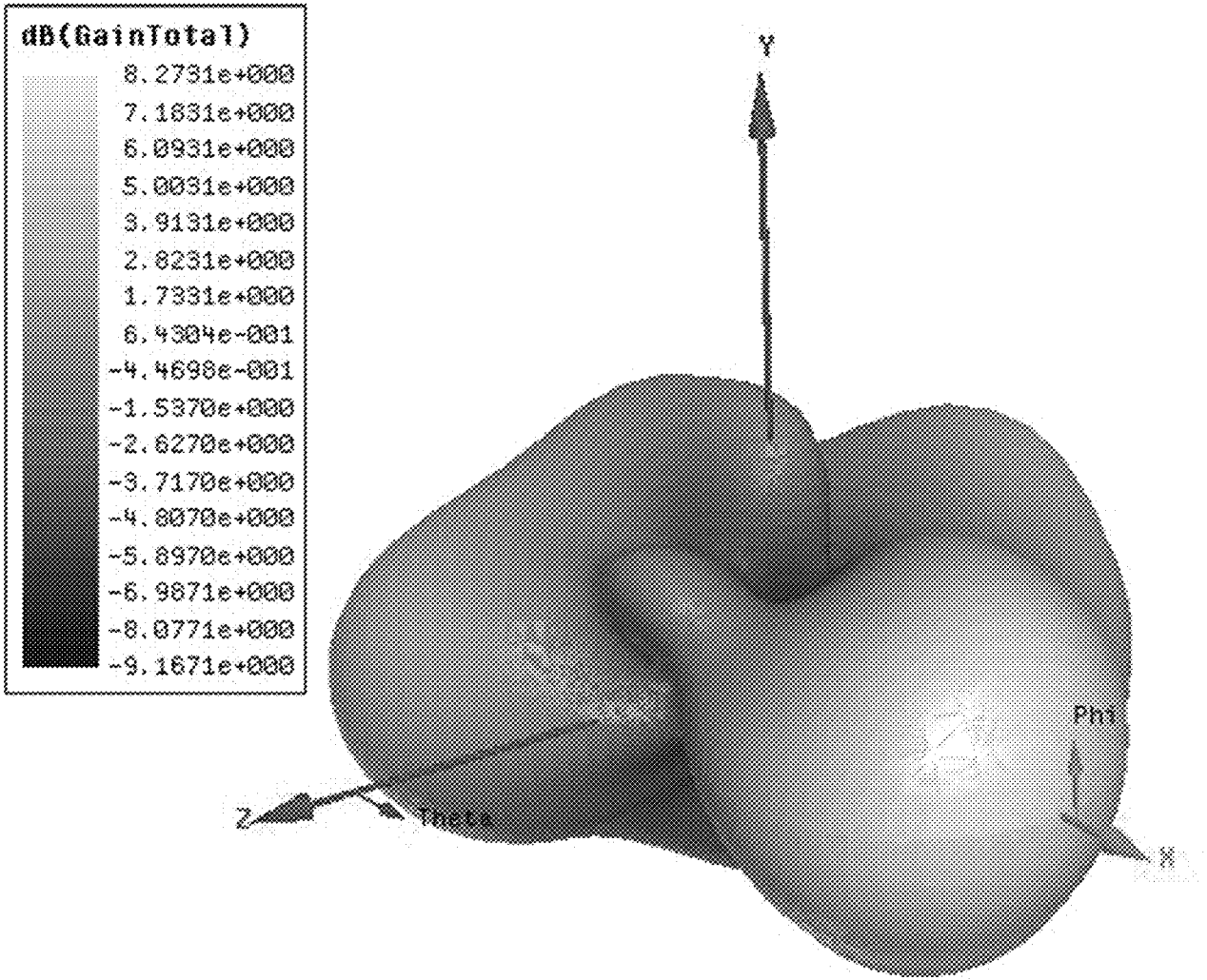
FIGS. 16 and 17 illustrate radiation patterns associated with the antenna structure of FIGS. 14 and 15, according to an example embodiment.
Figure 17:
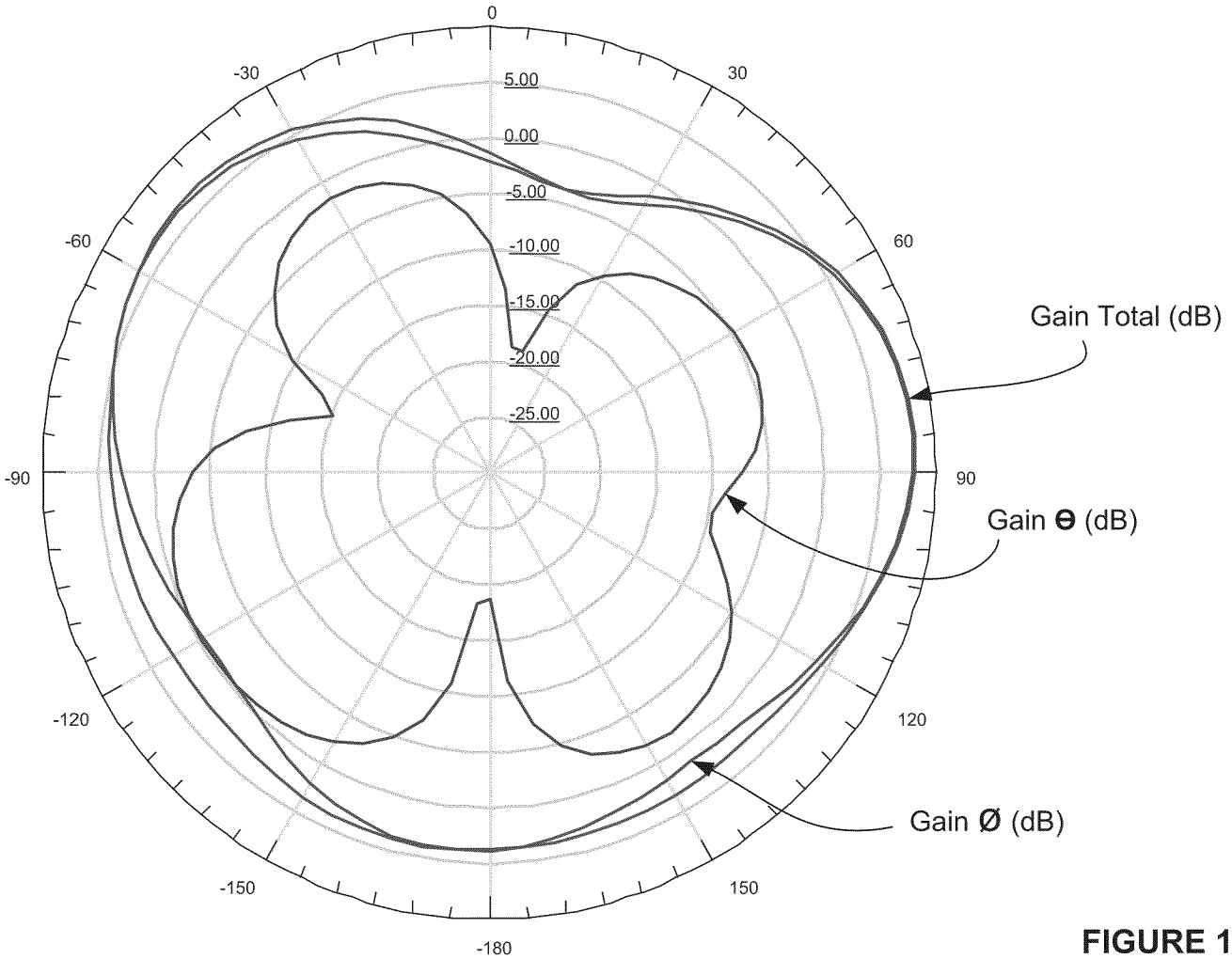

FIG. 16 illustrates the radiation pattern 240 generated by the antenna 200 of FIG. 14. The radiation pattern exhibits a further directionality than the antenna 150 of f as the lobes of the radiation pattern are more focused along the axes. FIG. 17 is a two dimensional plot of the radiation pattern in the y-z plane.

Figure 18:
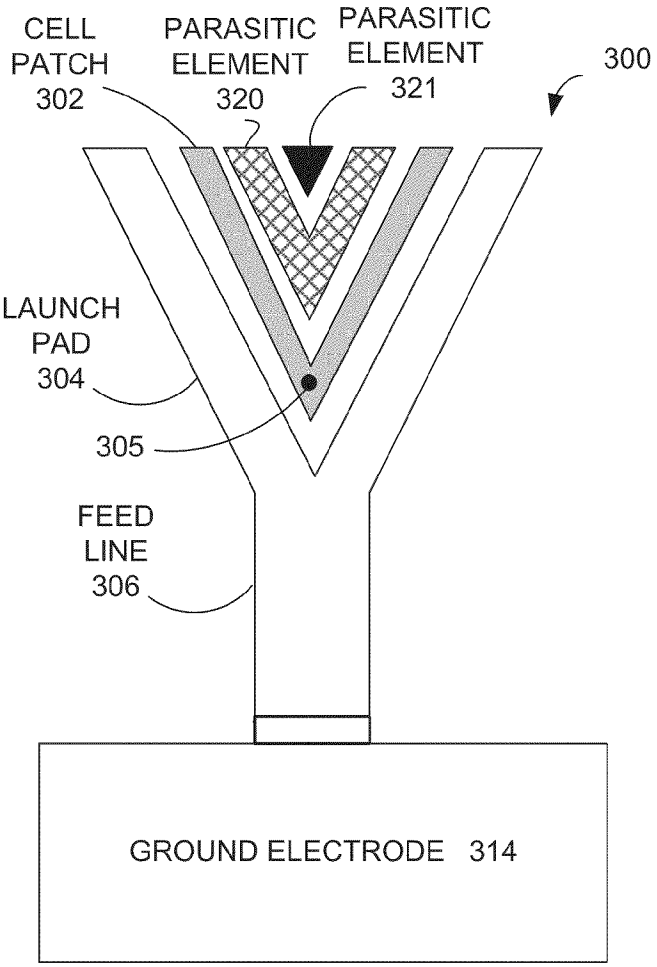

FIG. 18 illustrates an embodiment of an antenna 300 having multiple parasitic capacitive elements 320 and 321. The configuration is similar to that of antenna 200, having a feed line 306 and a launch pad 304 which together form a Y-shaped structure. The antenna 300 further includes a cell patch 308 having a V-shape complementary to the launch pad 304. The first parasitic capacitive element 320 is positioned proximate the cell patch 308. The second parasitic capacitive element 321 is positioned proximate the first parasitic element 320. Operation of the multiple parasitic capacitive elements 320 and 321 further focuses the directional antenna radiation. The cell patch 302 has a via connection point, which may be referred to as part of the via, coupling the cell patch 302 to a via pad in another layer (not shown), such as the via pad 214 and the via line 212 of antenna 200 illustrated in FIG. 11. The parasitic capacitive elements 320 and 321 are illustrated in this embodiment having a V-shape. Other embodiments may implement a variety of shapes and configurations to add parasitic capacitance to the antenna structure. Similarly, other RF structures may incorporate a parasitic capacitance to increase the directionality of a device.

Figure 19:
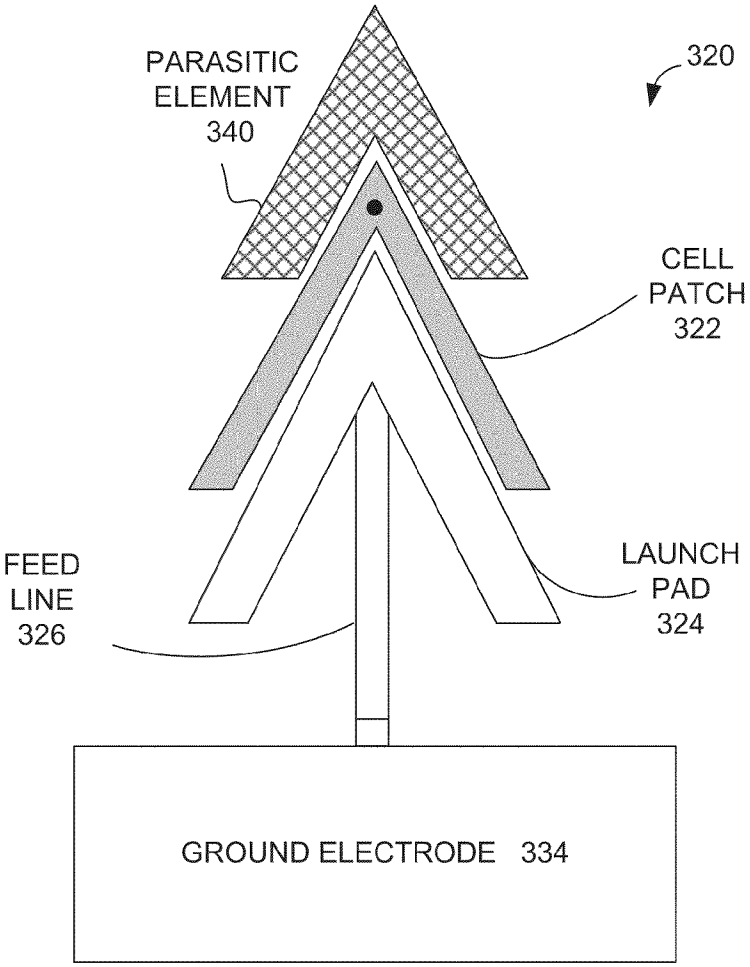
FIGS. 18, 19 and 20 illustrate antenna structures having capacitive elements, according to example embodiments.
Figure 20:
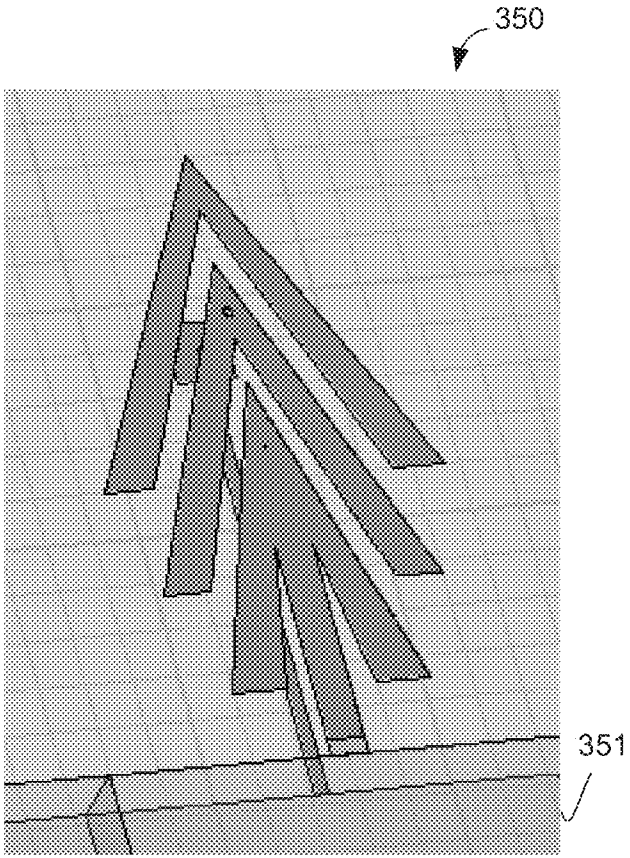

A variety of shapes and configurations are possible which provide for a launch pad and cell patch configuration that provides a directional antenna radiation pattern having high gain. FIG. 19 illustrates an embodiment of an antenna 320 having a different shape which is an inverted V-shape. The launch pad 324 is coupled to the feed line 326 and forms an inverted V-shape over the feed line 326. The cell patch 322 has a corresponding shape that is positioned proximate the launch pad 324. Finally, a parasitic element 340 is positioned proximate the cell patch 322. The combination of the parasitic element 340, the cell patch 322 and the launch pad 324 provide the radiator structure for the antenna 320. The cell patch 322 has a via connection point, or via portion, coupling the cell patch 322 to a via pad and via line in another layer (not shown). FIG. 20 further illustrates a configuration 350 positioning the antenna 320 on a substrate 351.

Figure 21:
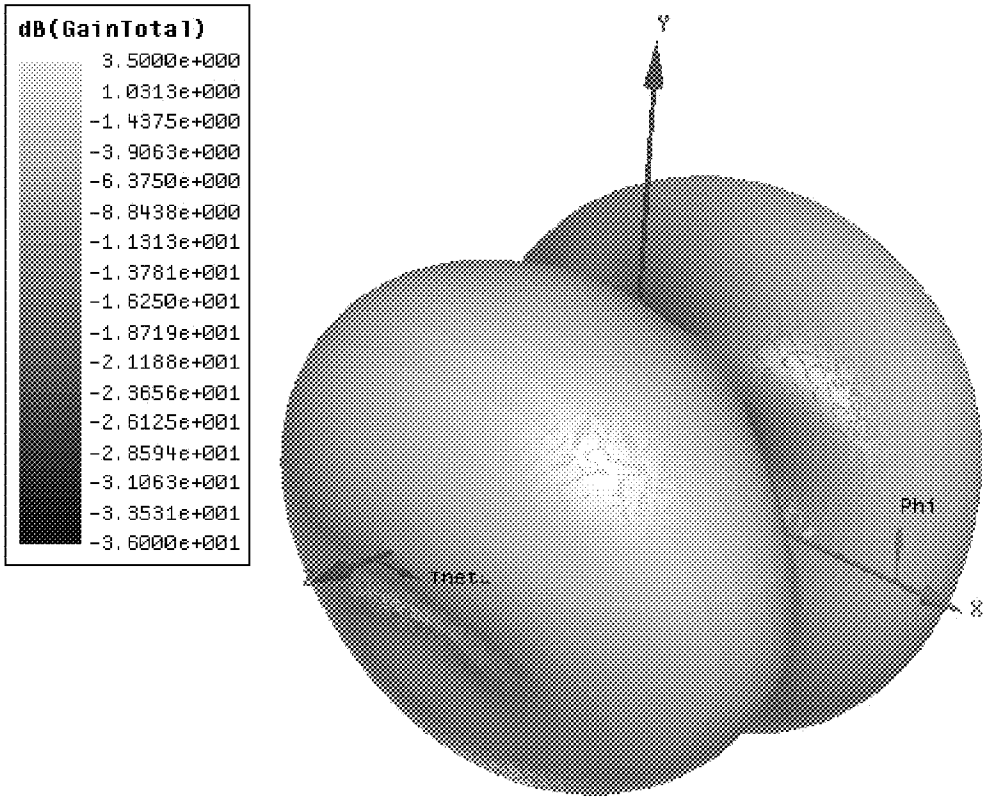
FIG. 21 illustrates a radiation pattern associated with an antenna structure as in FIGS. 19 and 20, according to an example embodiment.

FIG. 21 is a radiation pattern associated with the antenna 320, such as in configuration 350. There is a directionality introduced along in the y-z plane. A 2-dimensional radiation pattern may be used to further illustrate the behavior of an antenna structure, and specifically illustrate the gain improvement of various configurations incorporating a parasitic capacitive element. The 2-dimensional radiation pattern illustrates a cut of the radiation pattern as seen in the x-z plane, and illustrates the dBi gain of this embodiment.

Figure 22:
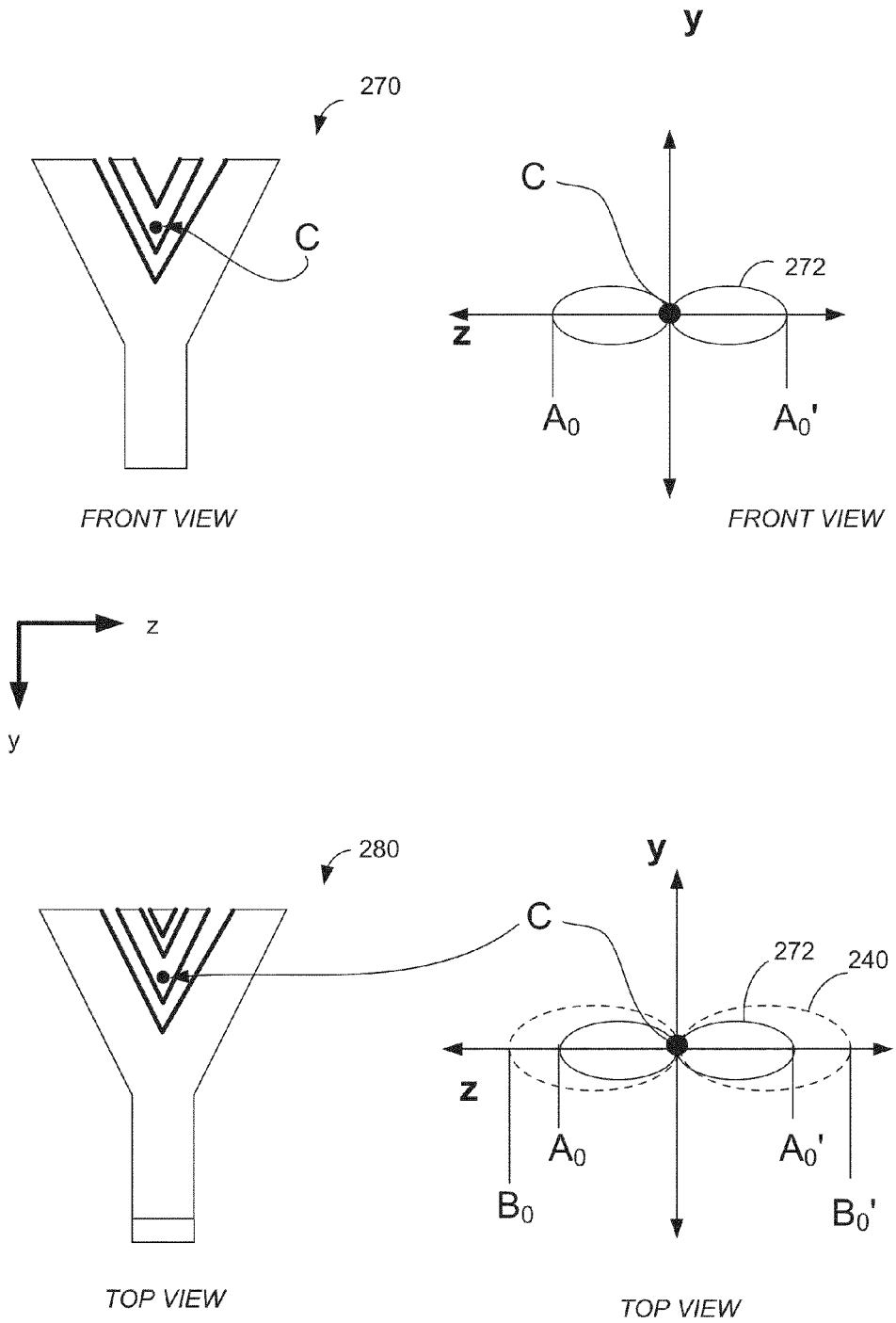
FIGS. 22 and 23 illustrate a change in radiation pattern incurred by the addition of a capacitive element, according to various embodiments.

FIG. 22 illustrates a sample radiation pattern associated with an antenna 280 similar to antenna 200 of FIG. 11. The radiation patterns illustrated in FIG. 22 are simplistic examples to facilitate clarity of understanding, and do not represent actual measured values. These patterns illustrate the change in directionality associated with different shapes and configurations of antenna structures having capacitive elements. The radiation pattern 240 is identified by the dashed line having two lobes extending along the z axis. The length of the lobes is identified $B_0$ and $B_0'$. A comparative radiation pattern 272 is also illustrated representing the radiation pattern associated with antenna structure 150 of FIG. 7. The radiation pattern 272 has lobes extending along the z-axis, with length identified by $A_0$ and $A_0'$. As illustrated, the additional capacitive element 220 results in a more focused radiation pattern along the z axis, and therefore $B_0>A_0$ and $A_0'>A_0'$. The radiation pattern 240 is illustrated in this example as an approximately elliptical shape, however, the shape may take any of a variety of forms. The actual radiation pattern may be irregularly shaped with a greater length defined along the y-axis than the z-axis. Some shapes may have a greater length defined along the z-axis than the y-axis and therefore have a greater z-directionality. The antenna 200 is a directed antenna with high gain along the axis of directionality.

Figure 23:
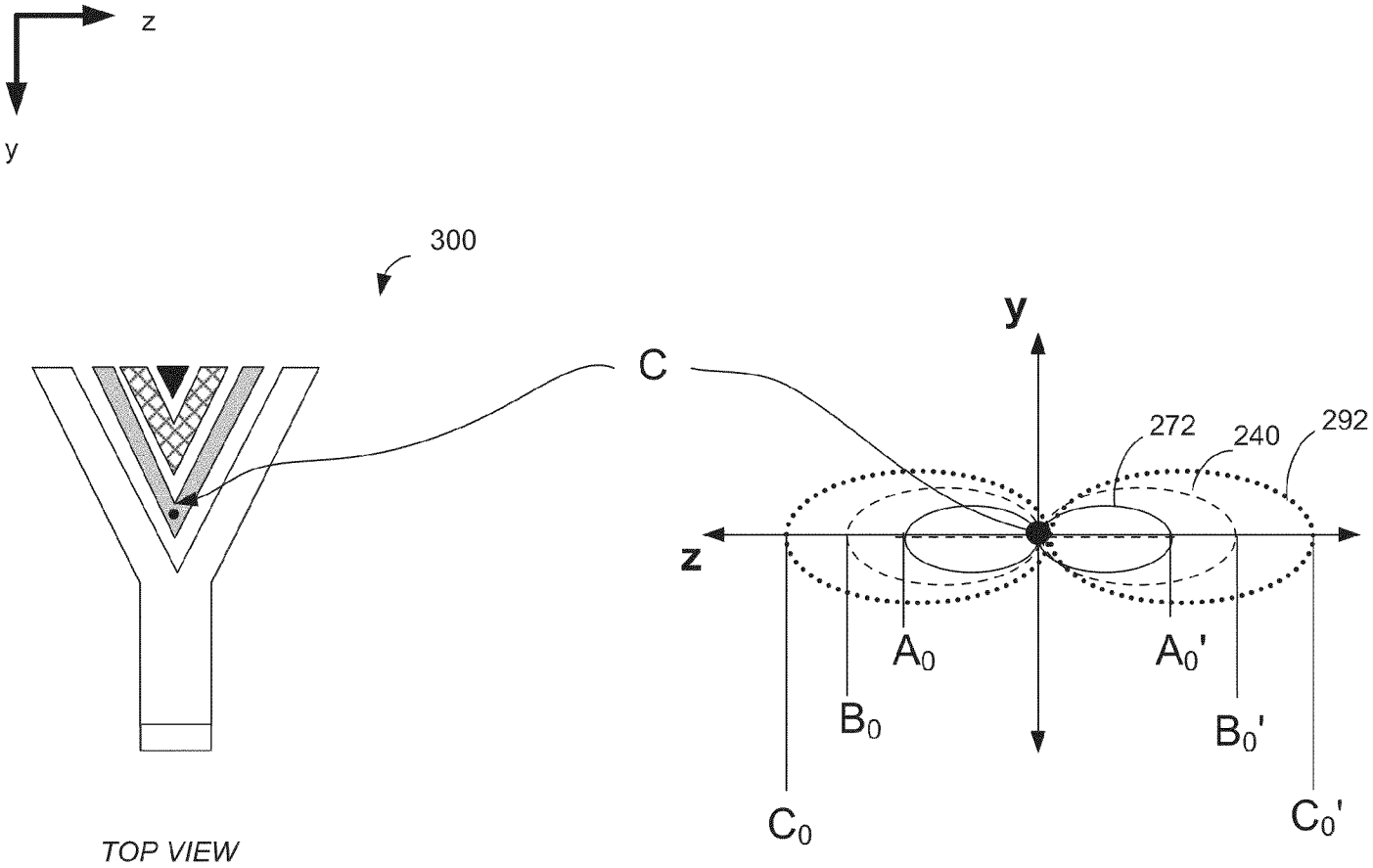

FIG. 23 illustrates the radiation pattern for antenna 300 of FIG. 18 having capacitive element 321. The antenna 300 has a via 305; the via 305 identifies the center point C of the radiation pattern 292 identified by the dashed, bold line. For comparison and clarity of understanding, the radiation patterns 240 and 272 of FIG. 22 are reproduced here. The radiation pattern 292 has lobes extending along the z-axis. As illustrated, the radiation pattern 292 is more directional than the patterns 240 and 272. As parasitic capacitive elements are added to the structure, the resultant radiation pattern becomes more focused along the z-axis. The pattern 292 has a length on each side of the z-axis from the center point C identified by $C_0$ and $C_0'$. The length of pattern 292 is greater than the length of pattern 272. The radiation pattern 240 has a more narrowly directed, or more specifically directed, beam than the radiation pattern 272. The specific change is dependent on the size of the parasitic capacitive element, as well as the frequency range and amplitude of the transmitted and received signals. Additionally, performance is a function of the shape of the parasitic capacitive element, the number of parasitic capacitive elements, and the coupling gaps between the parasitic capacitive element(s) and the cell patch of a given antenna. Therefore, design of a directional antenna may be enhanced by configuration of one or more parasitic capacitive elements. The addition of further parasitic capacitive elements may act to extend the signal into one or more directions. Such configuration may be adjusted to achieve a desired directionality.

Figure 25:
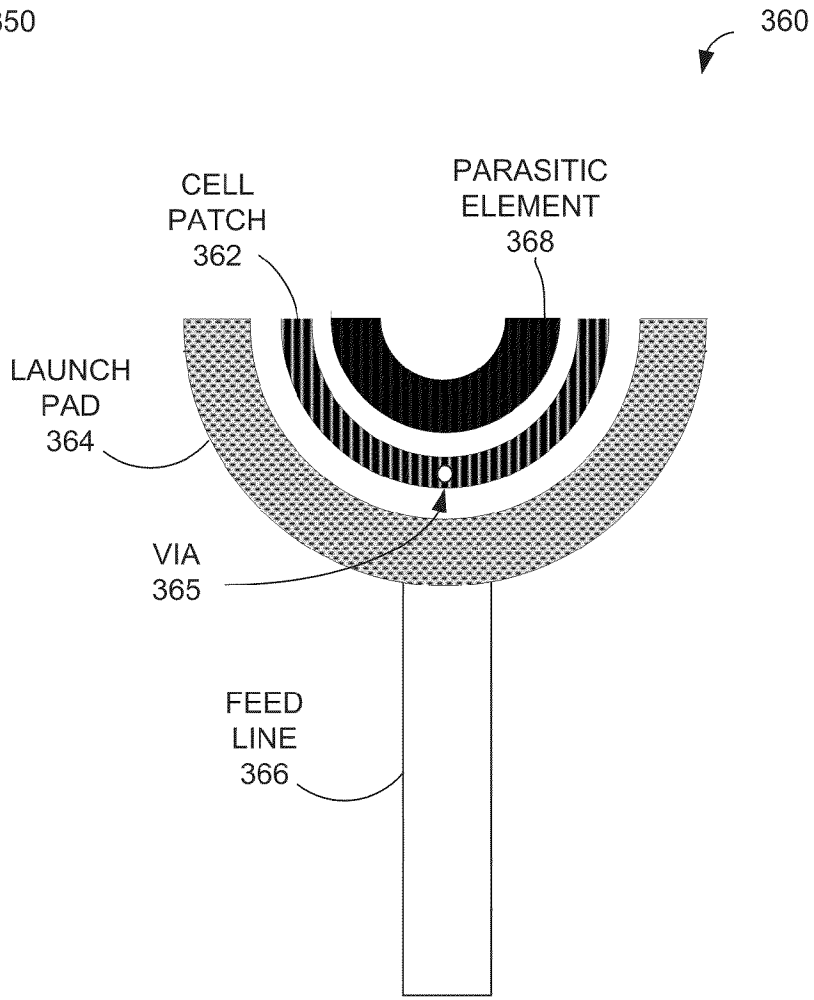
FIGS. 24 and 25 illustrate alternate shaped antenna structures implementing capacitive elements, according to various embodiments.
Figure 24:
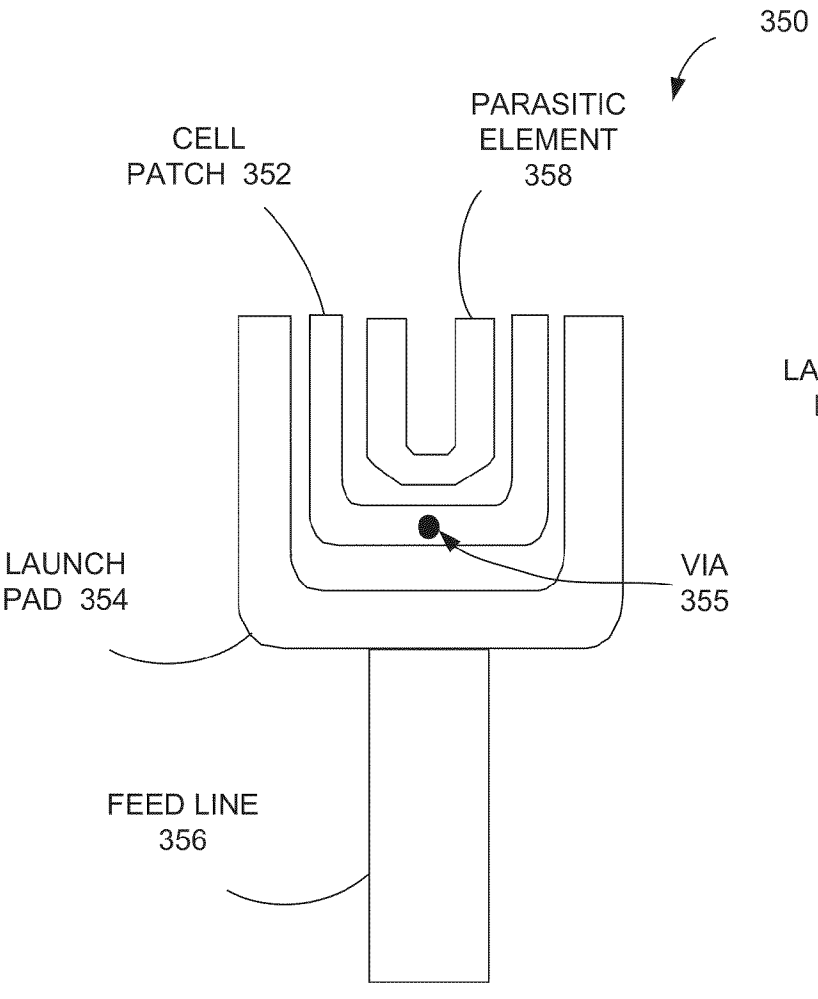

Other embodiments and antenna configurations may be designed to achieve the directional extension of the radiation pattern of an antenna. FIGS. 24 and 25 illustrate embodiments of different antenna structures. The antenna 350 has a U-shaped launch pad 354 coupled to a feed line 356, and has a complementary U-shaped cell patch 352 and parasitic capacitive element 358. As illustrated, the parasitic capacitive element 358 is also a U-shape, however, alternate configurations may be implemented, such as a U-shaped element, similar to some of the V-shaped antenna structures. Such structures are configured to result in a radiation pattern having a narrow beam-width or higher directionality, as seen in the x-z plane, in comparison to other design antennas, such as illustrated in FIGS. 1 and 2.

The antenna 360 has a semi-circular or bowl-shaped launch pad 364 and cell patch 368. The launch pad 364 is coupled to a feed line 366. The parasitic capacitive element 358 has a bowl-shape corresponding to that of the cell patch 368. As illustrated, the parasitic capacitive element 368 also has a bowl shape, however, alternate configurations may be implemented, such as a filled element shaped similar to that of the cell patch 368 or otherwise. Variations on the shape and configuration may be implemented to achieve a desired directionality. Some embodiments of these shaped antennas have radiation patterns similar to that of antenna 200 of FIG. 11.

FIG. 26 illustrates an application 400 having multiple antennas having parasitic elements, according to an example embodiments. As illustrated, antennas 402, 404 and 406 are positioned with respect to a substrate 414. The substrate 414 may include a ground electrode or ground layer, which may a full layer of the substrate 414 or may be a patterned portion of a layer of the substrate 414. Each of the antennas 402, 404 and 406 has a configuration as discussed with respect to antenna 200 of FIG. 11 and antenna 300 of FIG. 23. The antenna 404 has a first radiation pattern 422. The radiation pattern 422 is affected by the position of the antenna 404 with respect to the substrate 414, and specifically with respect to a ground layer or portion of the substrate 414. The radiation pattern 420 of the antenna 402 is different from the radiation pattern 422 of antenna 404 due to the location of the antenna 402 at the far end of the substrate 414 which has less interaction with the substrate. The radiation pattern 420 is directed away from the substrate 414. A similar radiation pattern 424 is seen at antenna 406. Note that the antennas may be positioned along the substrate 414, wherein the closer the antenna is located to the end of the substrate, the more impact on the directionality of the radiation pattern is experienced.

Figure 27:
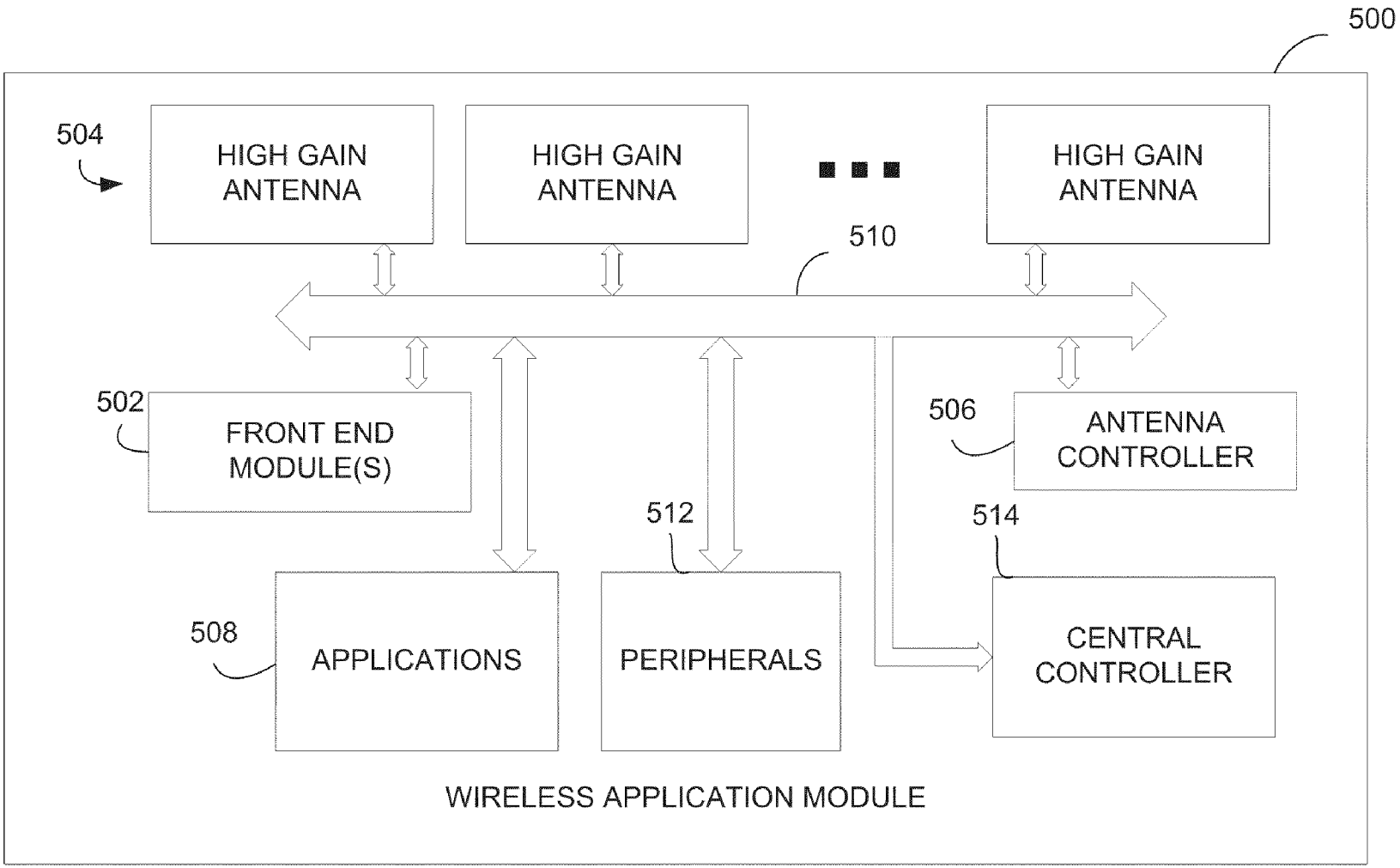
FIG. 27 illustrates a wireless device incorporating an antenna having at least one parasitic capacitive element, according to an example embodiment.

FIG. 27 illustrates an application 500 according to an example embodiment, having a central controller 514 for controlling operation of modules and components within application 500. The application 500 may be a wireless communication device or a wireless device used in a stationary or mobile environment. The application 500 further includes an antenna controller 506 to control operation of a plurality of high gain antennas 504. A communication bus 510 is provided for communication within the application 500, however, alternate embodiments may have direct connectivity between modules. The communication bus 5210 is further coupled to the front end modules 502 for receiving communications and transmitting communications. The application 500 includes hardware, software, firmware or a combination thereof, which are part of the functional applications 508. Peripheral devices 512 are also coupled to the communication bus 510. In operation, the application 500 provides functionality which includes or is enhanced by wireless access and communication. The high gain antennas 504 are MTM antenna structures, each including a parasitic element.

Figure 28:
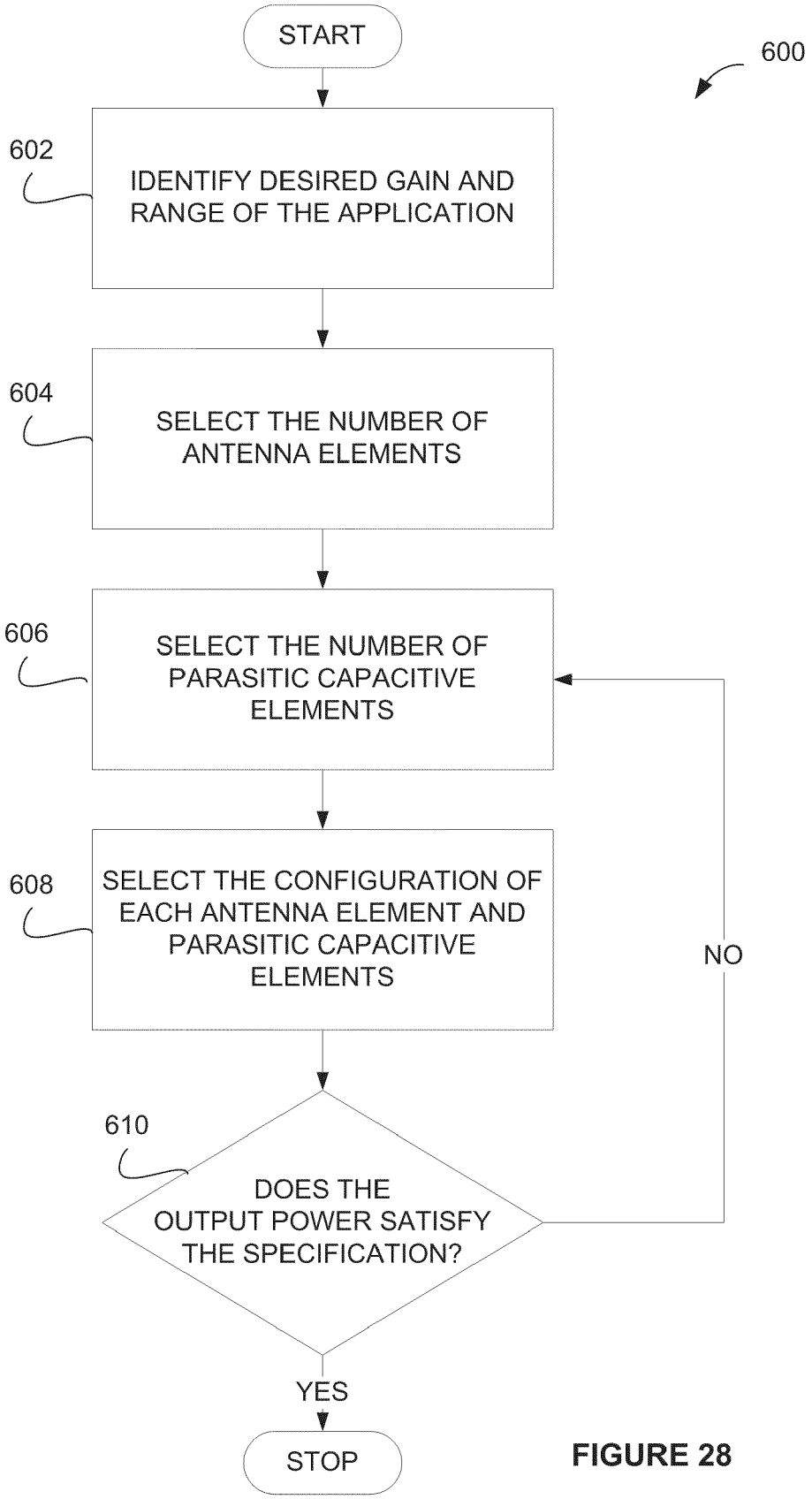
FIG. 28 illustrates a method for generating an antenna having a parasitic capacitive element, according to an example embodiment.

FIG. 28 illustrates a method for designing an application and building the device. The process 600 starts by identifying a desired gain and range of the target application, operation 602. The process then includes operations to select the number of antenna elements, operation 604, and select the number of parasitic capacitive elements for these antenna elements, operation 606. The process then includes operations to select a configuration of the antenna elements with the parasitic capacitive elements. At decision point 610 the designer determines if the output power satisfies the specification and requirements of the application. When the design satisfies the specification, the design is complete, else processing returns to operation 606 to continue the design. Some applications may include a combination of high gain antennas, where at least one antenna has a parasitic capacitive element or elements. Similarly, an application may include a variety of shapes and configurations of MTM antennas having various shapes associated with the parasitic elements.

Figure 29:
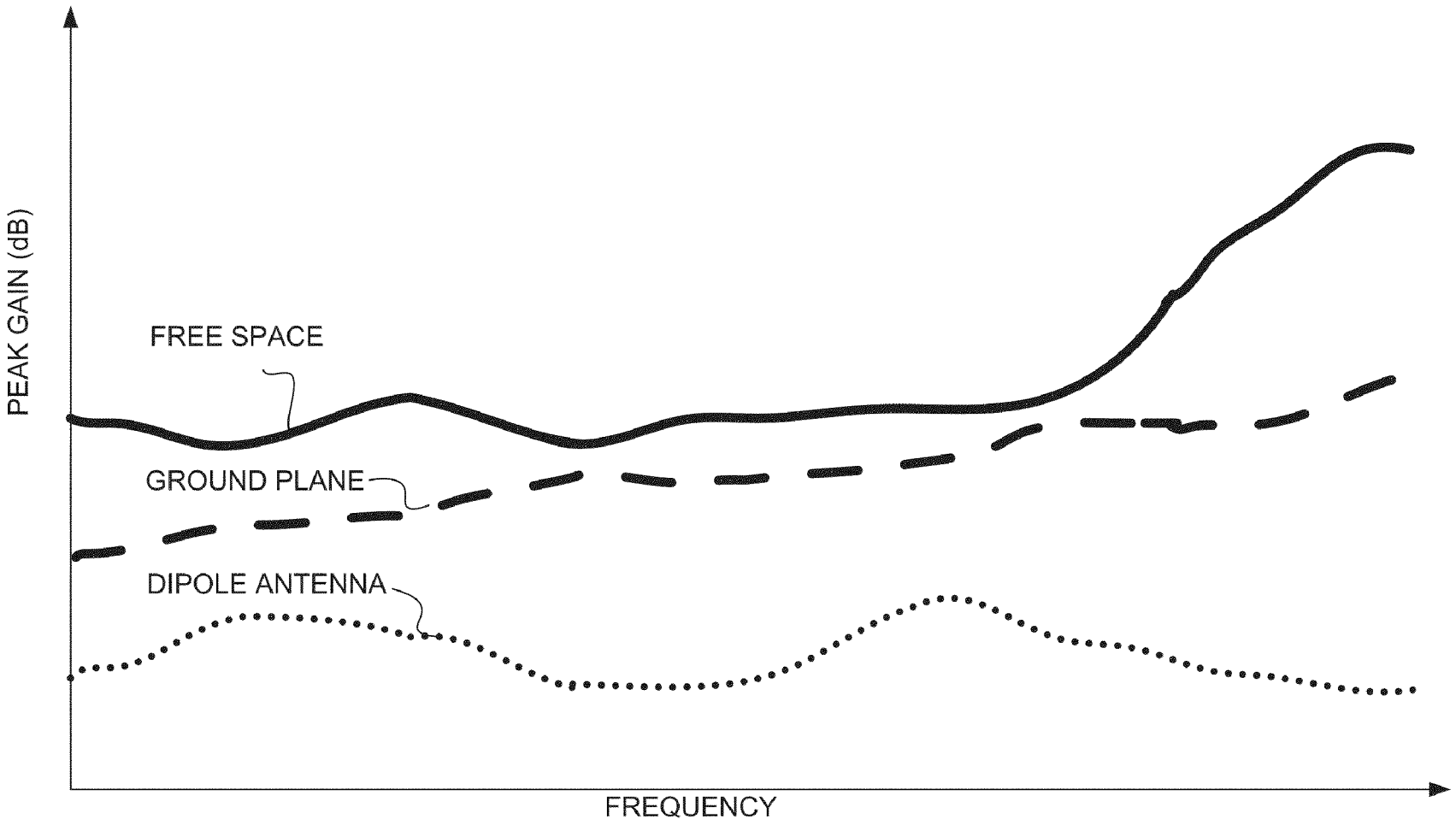
FIGS. 29 and 30 are plots of the expected peak gains associated with various antenna configurations, according to example embodiments.

FIG. 29 is a graph of the estimated peak gain of an antenna having a parasitic capacitive element. The results plotted in FIG. 29 consider the antenna operating in free space, which is illustrated by a solid line. In another scenario, the antenna is positioned perpendicular to the ground plane, which is illustrated by the dashed line with the long dashes. The estimated peak gain of a dipole antenna is also graphed for comparison, which is illustrated by the dashed line with the long dashes. As illustrated, the estimated peak gain of the antenna, such as antenna 200, increases at higher frequencies.

Figure 30:
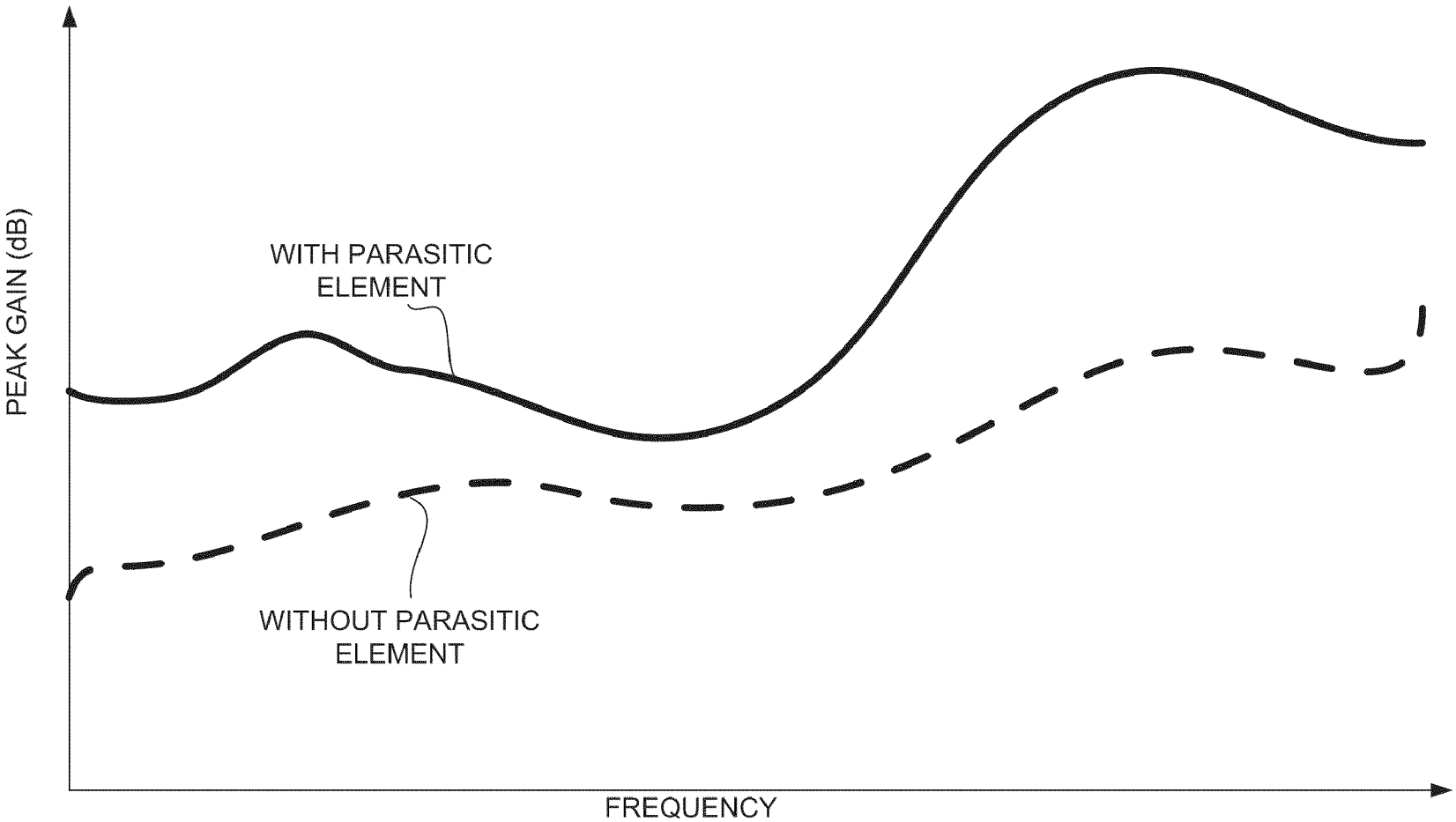

FIG. 30 is a plot of the peak gain of an antenna with at least one parasitic element and an antenna without any parasitic element. The gain is plotted in dB and as a function of frequency. As illustrated, there is an improvement in the peak gain with the parasitic element.

As illustrated in the above embodiments and examples a directional antenna with a parasitic capacitive element may be designed for achieving high gain. In some embodiments, the expected peak gain is comparable to a dipole antenna and may increase peak gain while maintaining a small footprint. Additionally, some embodiments are provided as printed structures on a substrate. The antenna includes a launch pad and cell patch formed on a first layer of a substrate, wherein a via couples the cell patch to a ground portion of another layer separated by a dielectric. The directionality of the antenna is a function of the shape of the launch pad, the cell patch and the parasitic element. In some embodiments the antenna performance is a function of the direction and angle of the flare of the antenna structure.

Some embodiments provide a two dimensional equivalent of a horn antenna, where the launch pad, the cell patch and the parasitic element are a nested, symmetric horn shape, such as a V-shape structure. This allows the antenna to achieve the directionality and high gain of a horn antenna without the three dimensional construction of a cone. Some embodiments implement a variety of other shapes, such as a U shape, a cross-sectional cup shape, or any two-dimensional shape having arms spreading outwardly from a narrow to a wider span.

It should be noted that the electric field distribution of the high gain antenna described herein, such as an MTM antenna, provides a strong coupling between the launch pad to ground, such as illustrated in FIG. 13, wherein an electromagnetic coupling is created between the launch pad 204 and the ground 222 of the top layer.

The directivity of the high gain MTM antenna may be further increased with the one or more parasitic elements. The parasitic elements do not extend the length of the antenna, whereas the directivity of a horn antenna is increased with length of the horn.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, it is understood that variations and enhancements may be made.

The invention claimed is:

1. An antenna device, comprising:

a substrate having two conductive layers separated by a dielectric layer;

a first metal portion patterned onto a first layer of the substrate, the first metal portion have a flared shape;

a second metal portion patterned onto the first layer of the substrate, the second metal portion having a second shape corresponding to the flared shape of the first metal portion and having a first side proximate the first metal portion; and a parasitic element patterned onto the first layer of the substrate, the parasitic element having a shape corresponding to the second shape positioned proximate a second side of the second metal portion.

2. The antenna of claim 1, wherein the antenna is a Composite Right and Left Handed (CRLH) structure.

3. The antenna of claim 2, wherein signals are guided through the CRLH structure to radiate in a first direction.

4. The antenna of claim 2, wherein the antenna is a unit cell, the first metal portion is a launch pad and the second metal portion is a cell patch.

5. The antenna of claim 1, wherein the flared shape is a V-shape.

6. The antenna of claim 1, wherein the parasitic element is a parasitic capacitive element comprising a plurality of nested shapes.

7. The antenna of claim 2, wherein the flared shape is symmetric with respect to a feed line coupled to the first metal portion.

8. The antenna as in claim 2, wherein the flared shape is a U-shape.

9. The antenna of claim 2, wherein the flared shape is a semi-circular shape.

10. The antenna of claim 2, wherein the antenna further comprises a via to a second layer of the substrate.

11. A wireless apparatus, comprising:

a substrate having two conductive layers separated by a dielectric layer;

a first metal portion patterned onto a first layer of the substrate, the first metal portion have a flared shape;

a second metal portion patterned onto the first layer of the substrate, the second metal portion having a second shape corresponding to the flared shape of the first metal portion and having a first side proximate the first metal portion;

a parasitic element patterned onto the first layer of the substrate, the parasitic element having a shape corresponding to the second shape and positioned proximate a second side of the second metal portion; and a transceiver coupled to the first metal portion.

12. The apparatus of claim 11, wherein the first and second metal portions, and the parasitic element form an antenna, and the antenna is a Composite Right and Left Handed (CRLH) structure.

13. The apparatus of claim 12, wherein the flared shape is a V-shape.

14. A method for manufacturing an antenna, comprising:

forming a first metal portion patterned onto a first layer of a substrate, the first metal portion have a flared shape, the substrate having two conductive layers separated by a dielectric layer;

forming a second metal portion onto the first layer of the substrate, the second metal portion having a second shape corresponding to the flared shape of the first metal portion and having a first side proximate the first metal portion; and forming a parasitic element on the first layer of the substrate, the parasitic element having a shape corresponding to the second shape and positioned proximate a second side of the second metal portion.

15. The method of claim 14, comprising forming a Composite Right and Left Handed (CRLH) structure, comprising the forming the first and second layers and the forming the parasitic element.

16. A method, comprising:

receiving an electrical signal at a first metal portion of an antenna comprising a Composite Right and Left Handed (CRLH) structure, the first metal portion having a flared shape;

inducing charge onto a second metal portion of the antenna, from the first metal portion, the second metal portion having a second shape corresponding to the flared shape of the first metal portion and having a first side proximate the first metal portion;

inducing the charge onto a parasitic element of the antenna, from the second metal portion, the parasitic element having a shape corresponding to the second shape positioned proximate a second side of the second metal portion; and in response, transmitting an electromagnetic wave from the antenna, the electromagnetic wave representative of the electrical signal.

17. The method of claim 16, further comprising:

capturing a portion of an incident propagating electromagnetic wave to provide a received electrical signal representative of the incident propagating electromagnetic wave, at the parasitic element;

inducing charge onto the second metal portion from the parasitic element;

inducing charge onto the first metal portion from the second metal portion; and in response, using the first metal portion, providing the received electrical signal representative of the incident propagating electromagnetic wave for processing by a wireless apparatus.

18. The apparatus of claim 12, wherein the antenna is a unit cell of the CRLH structure, the first metal portion is a launch pad, and the second metal portion is a cell patch.

19. The method of claim 15, wherein the antenna is a unit cell of the CRLH structure, the first metal portion is a launch pad, and the second metal portion is a cell patch.

20. The method of claim 16, wherein the antenna is a unit cell of the CRLH structure, the first metal portion is a launch pad, and the second metal portion is a cell patch.

* * * * *